US009802752B2

(12) United States Patent
Cohen et al.

(10) Patent No.: US 9,802,752 B2
(45) Date of Patent: Oct. 31, 2017

(54) SHROUD AND DISPENSING SYSTEM FOR A HANDHELD CONTAINER

(71) Applicant: S.C. Johnson & Son, Inc., Racine, WI (US)

(72) Inventors: Erica Eden Cohen, New York, NY (US); Kevin Harrity, Oak Creek, WI (US); Jonathan N. Mandell, Gurnee, IL (US); Nicholas Oxley, New York, NY (US); Thomas A. Renner, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 143 days.

(21) Appl. No.: 14/689,678

(22) Filed: Apr. 17, 2015

(65) Prior Publication Data

US 2015/0225167 A1 Aug. 13, 2015

Related U.S. Application Data

(63) Continuation of application No. 13/112,559, filed on May 20, 2011, now Pat. No. 9,051,108.

(60) Provisional application No. 61/347,285, filed on May 21, 2010, provisional application No. 61/406,074, filed on Oct. 22, 2010.

(51) Int. Cl.

| | |
|---|---|
| ***B65D 83/00*** | (2006.01) |
| ***B65D 83/38*** | (2006.01) |
| ***B65D 83/20*** | (2006.01) |
| ***B65D 83/22*** | (2006.01) |
| ***B65D 83/40*** | (2006.01) |

(52) U.S. Cl.
CPC ..... *B65D 83/384* (2013.01); *B65D 83/201* (2013.01); *B65D 83/226* (2013.01); *B65D 83/40* (2013.01)

(58) Field of Classification Search
CPC .... B65D 83/386; B65D 83/384; B65D 83/38; B65D 83/40
USPC ..... 222/206–215, 402.1–402.25
See application file for complete search history.

(56) References Cited

U.S. PATENT DOCUMENTS

| | | | | |
|---|---|---|---|---|
| 3,254,803 | A * | 6/1966 | Meshberg | B65D 83/386 222/182 |
| 3,549,055 | A * | 12/1970 | Gatland | A61M 15/009 222/182 |
| 5,139,180 | A * | 8/1992 | Lucas | B65D 83/206 222/321.8 |
| 6,592,011 | B1 * | 7/2003 | Lammel | B65D 83/384 222/153.11 |
| 7,845,518 | B2 * | 12/2010 | Lasserre | B65D 83/20 222/135 |
| 2005/0224525 | A1 * | 10/2005 | Davies | A61M 15/08 222/402.15 |
| 2007/0023457 | A1 * | 2/2007 | O'Toole | B65D 83/206 222/402.13 |

(Continued)

*Primary Examiner* — Patrick M Buechner

(57) ABSTRACT

A dispensing system includes a manifold adapted to be fluidly coupled to a valve stem of a container. The manifold includes first and second members extending outwardly from the manifold. The dispensing system also includes a shroud having first and second shroud portions on opposing sides of the shroud. The dispensing system further includes at least one enclosed track. The enclosed track receives and permits sliding of at least one of the first and second members.

20 Claims, 38 Drawing Sheets

(56) References Cited

U.S. PATENT DOCUMENTS

| | | | | |
|---|---|---|---|---|
| 2011/0094506 | A1* | 4/2011 | Petit | B05B 11/305 128/200.14 |
| 2011/0192867 | A1* | 8/2011 | Best | B65D 83/206 222/402.13 |
| 2011/0220685 | A1* | 9/2011 | Lind | B65D 83/206 222/402.11 |

* cited by examiner

SHROUD AND DISPENSING SYSTEM FOR A HANDHELD CONTAINER

CROSS REFERENCE TO RELATED APPLICATIONS

This application is a continuation of U.S. Non-Provisional application Ser. No. 13/112,559, filed May 20, 2011, which claims the benefit of U.S. Provisional Application No. 61/347,285, filed May 21, 2010, and U.S. Provisional Application No. 61/406,074, filed on Oct. 22, 2010.

REFERENCE REGARDING FEDERALLY SPONSORED RESEARCH OR DEVELOPMENT

Not applicable

SEQUENTIAL LISTING

Not applicable

BACKGROUND OF THE DISCLOSURE

1. Field of the Disclosure

The present disclosure relates to a shroud adapted to facilitate the emission of a fluid product from a hand-held container.

2. Description of the Background of the Disclosure

Various hand-held dispensing systems are known in the prior art, which comprise a container, a cap, and a dispensing mechanism that facilitates the release of a fluid product. Generally, these dispensing mechanisms are manufactured without regard to various factors that assist in the use of the dispensing mechanisms and spraying of the fluid product. For example, in one type of system a container is provided with a cap, which includes a distinct button that extends from the cap. A user depresses the button to actuate a valve stem of the container to release fluid therefrom. In other prior art systems, actuation is accomplished via a trigger that extends from the cap. In use, some systems require a user to exert a relatively significant force on a specific location of the trigger to pivot same about a hinge axis to release fluid from the container. These prior systems fail to provide a dispensing mechanism that is universally easy to operate for different types of users, e.g., elderly people, parents holding children, people with disabilities, such as arthritis, etc.

Another significant obstacle to efficient and effective use of hand-held dispensing systems is that many of the prior art containers and caps are bulky and unwieldy for a user to hold and operate. Frequently, these systems use elongate cylindrical containers having a uniform diameter throughout a main portion of the container. Containers of this sort are easy to manufacture, but ignore significant challenges that users encounter in grasping and manipulating the container during use.

Another disadvantage of such prior dispensing systems is the unappealing aesthetics of such systems to typical users, which causes the systems to be stored out of view when not in use. Ideally, dispensing systems would be left out in plain sight so that they are easily accessible when needed. One specific feature of prior dispensing systems that users have found to be unappealing is the typical 30/70 ratio between portions of the cap that are visible and portions of the container that are visible, respectively.

The present disclosure provides new and non-obvious dispensing systems, which address one or more of the above issues.

SUMMARY OF THE INVENTION

According to one aspect, a dispensing system includes a manifold adapted to be fluidly coupled to a valve stem of a container, a shroud having first and second shroud portions on opposing sides of the shroud, and at least one enclosed track. The manifold includes first and second members extending outwardly from the manifold. The enclosed track receives and permits sliding of at least one of the first and second members.

According to another aspect, a dispensing system includes a manifold adapted to be fluidly coupled to a valve stem of a container, a shroud, and a cap. The manifold includes first and second members extending outwardly from the manifold. The shroud has first and second shroud portions on opposing sides of the shroud. A platform extends beyond one of the shroud portions toward the other, and the platform includes first and second rails extending therefrom. The cap includes first and second rails extending from a bottom surface thereof. The first and second rails of the cap are aligned with the first and second rails of the platform to form first and second tracks, respectively. The first and second members are disposed within the first and second tracks, respectively.

According to a different aspect, a dispensing system includes a manifold adapted to be fluidly coupled to a valve stem of a container, and a shroud having first and second shroud portions on opposing sides of the shroud. The manifold includes first and second members extending outwardly from the manifold. Movement of at least one of the first and second shroud portions causes the first shroud portion to contact the manifold, forcing same downwardly. Movement of the manifold is restrained by the movement of the first and second members within first and second tracks, respectively.

DETAILED DESCRIPTION OF THE DRAWINGS

Figure 1:
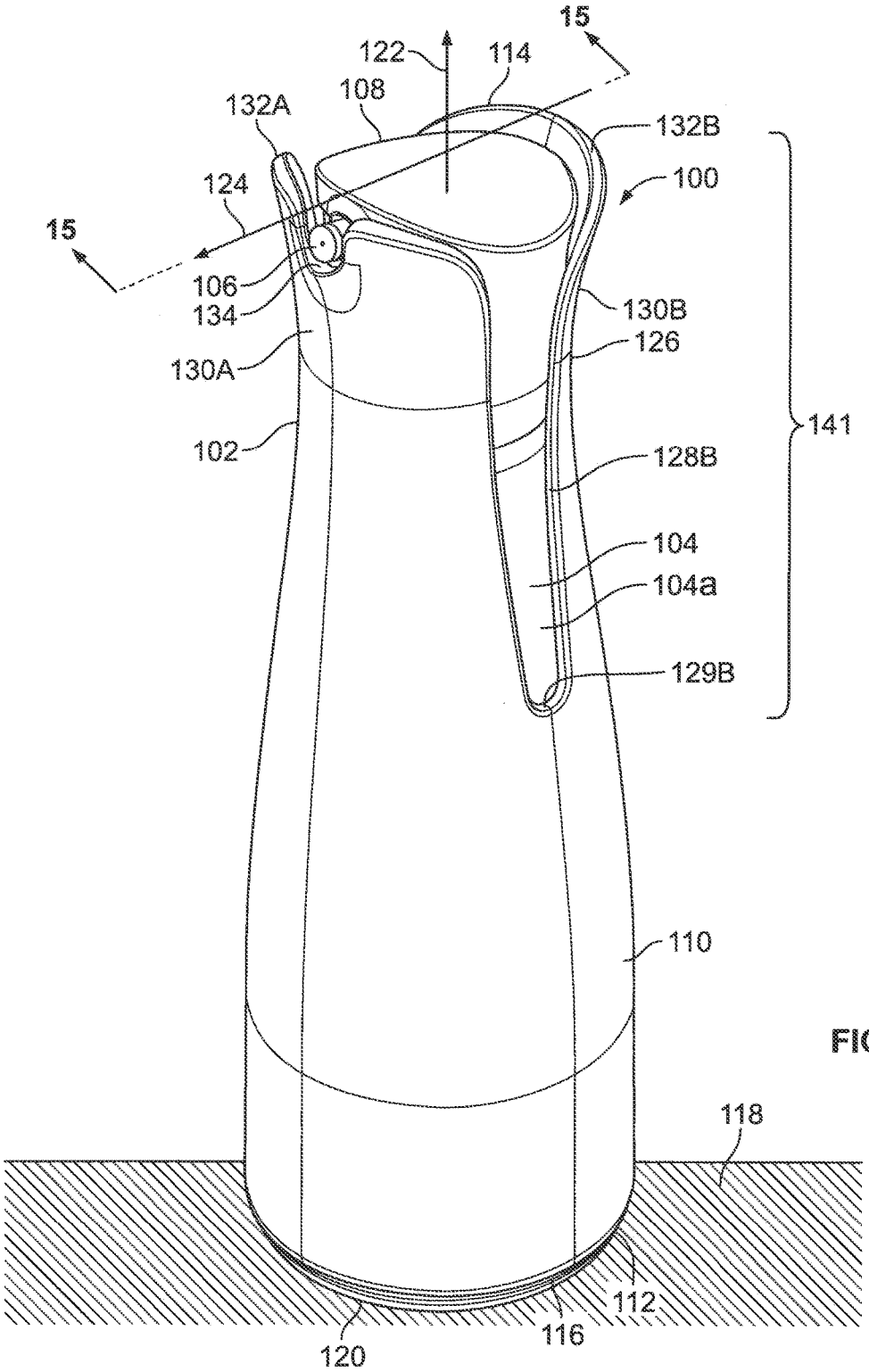
FIG. 1 is an isometric view of a top, front, and right side of a dispensing system that includes a shroud, a container, a manifold, and a cap.
Figure 2:
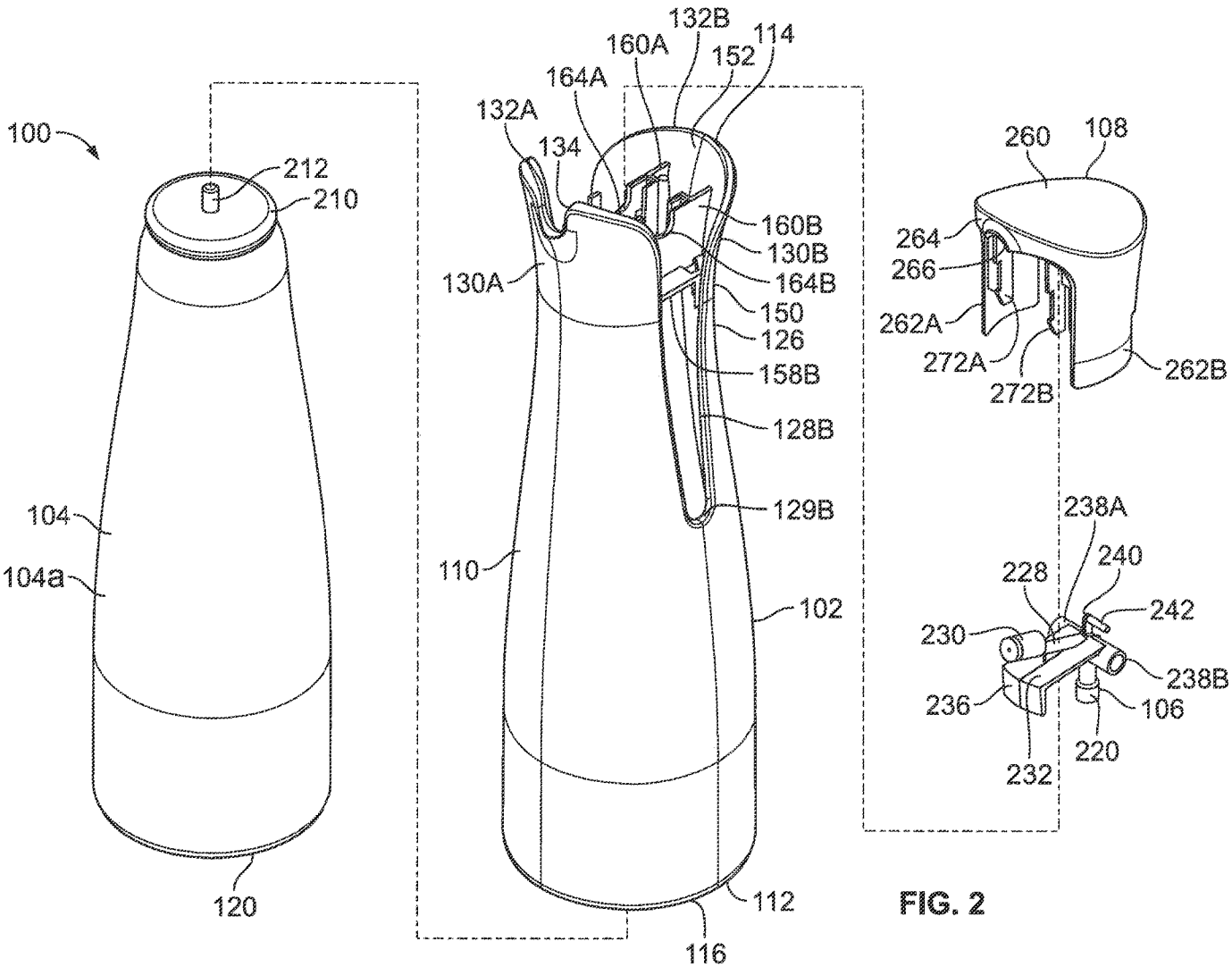
FIG. 2 is an exploded view of the dispensing system of FIG. 1.

Referring generally to FIGS. 1-15, one embodiment of a dispensing system 100 includes a shroud 102, a container 104, a manifold 106, and a cap 108. The shroud 102 includes a generally cylindrical side wall 110 that extends upwardly from a bottom edge 112 toward a top edge 114 thereof. An opening 116 is defined by the bottom edge 112 of the shroud 102, as seen more clearly in FIG. 6. As shown generally in FIG. 2, the container 104 is inserted into the opening 116 of the shroud 102 and the manifold 106 and the cap 108 are adapted to be at least partially disposed within an upper portion of the shroud 102, as will be described in more detail hereinafter.

In one embodiment, the bottom edge 112 of the shroud 102 is adapted to rest on a support surface 118, e.g., a table, a desk, a cabinet, etc. In another embodiment, a bottom edge 120 of the container 104 extends from the bottom edge 112 of the shroud 102 and is adapted to rest on the support surface 118. When resting on the support surface 118, a central or longitudinal axis 122 of the dispensing system 100 is generally perpendicular with respect to the support surface 118 (see FIG. 1). A secondary axis 124 is defined as being orthogonal to the longitudinal axis 122. The central axis 122 and the secondary axis 124 are defined herein for reference purposes only without intending any limitation. The container includes a length L defined by the longitudinal axis 122 of the dispensing system. More specifically, the length L of the container may be described as the distance between the bottom edge 120 of the container to a mounting cup thereof, i.e., the sidewall of the container, about the longitudinal axis 122. In one embodiment, the container is between about 5 cm to about 30 cm in length, and more preferably between about 10 cm to about 23 cm in length.

Figure 3:
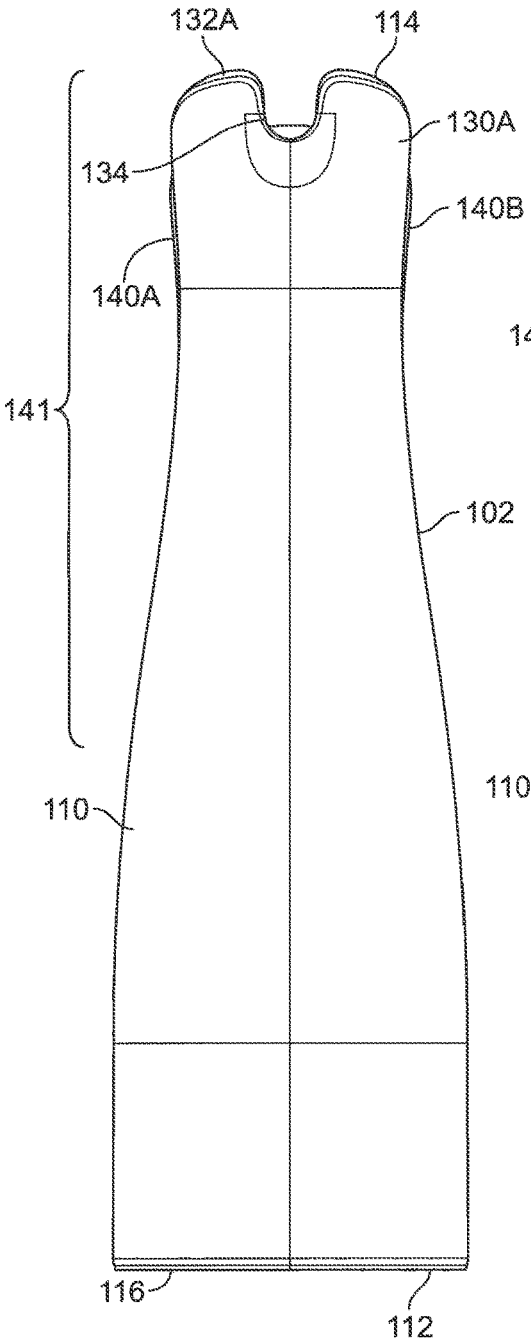
FIG. 3 is a front elevational view of the shroud of FIG. 1.
Figure 4:
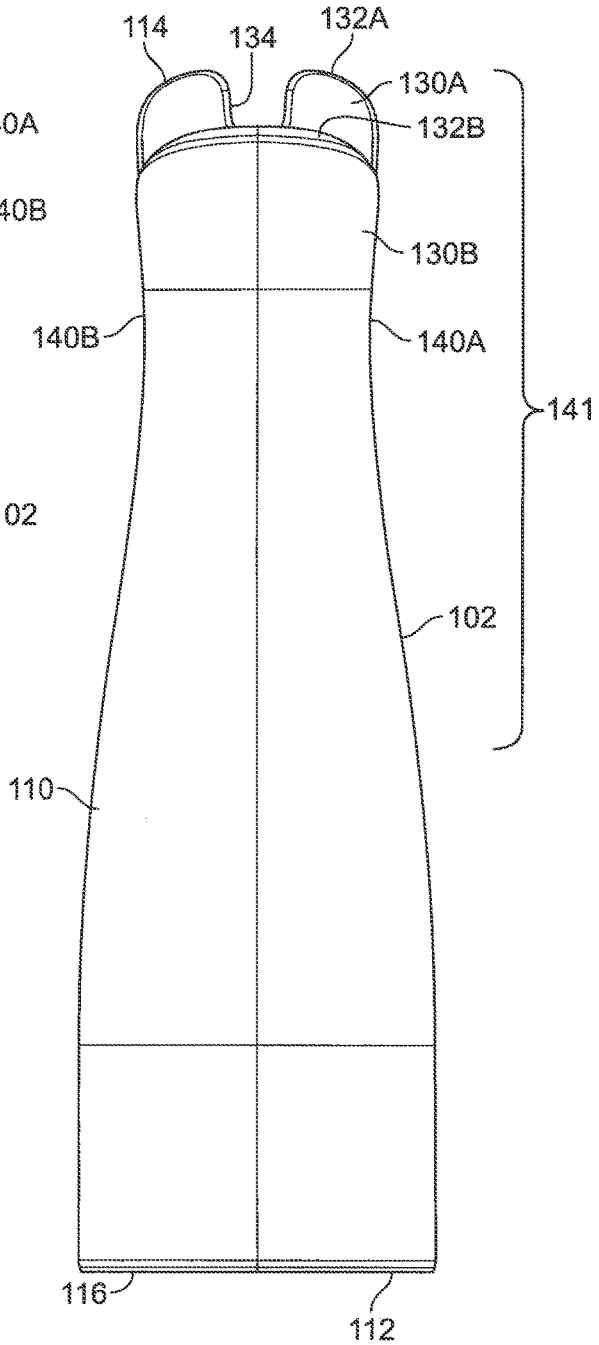
FIG. 4 is a back elevational view of the shroud of FIG. 1.
Figure 5:
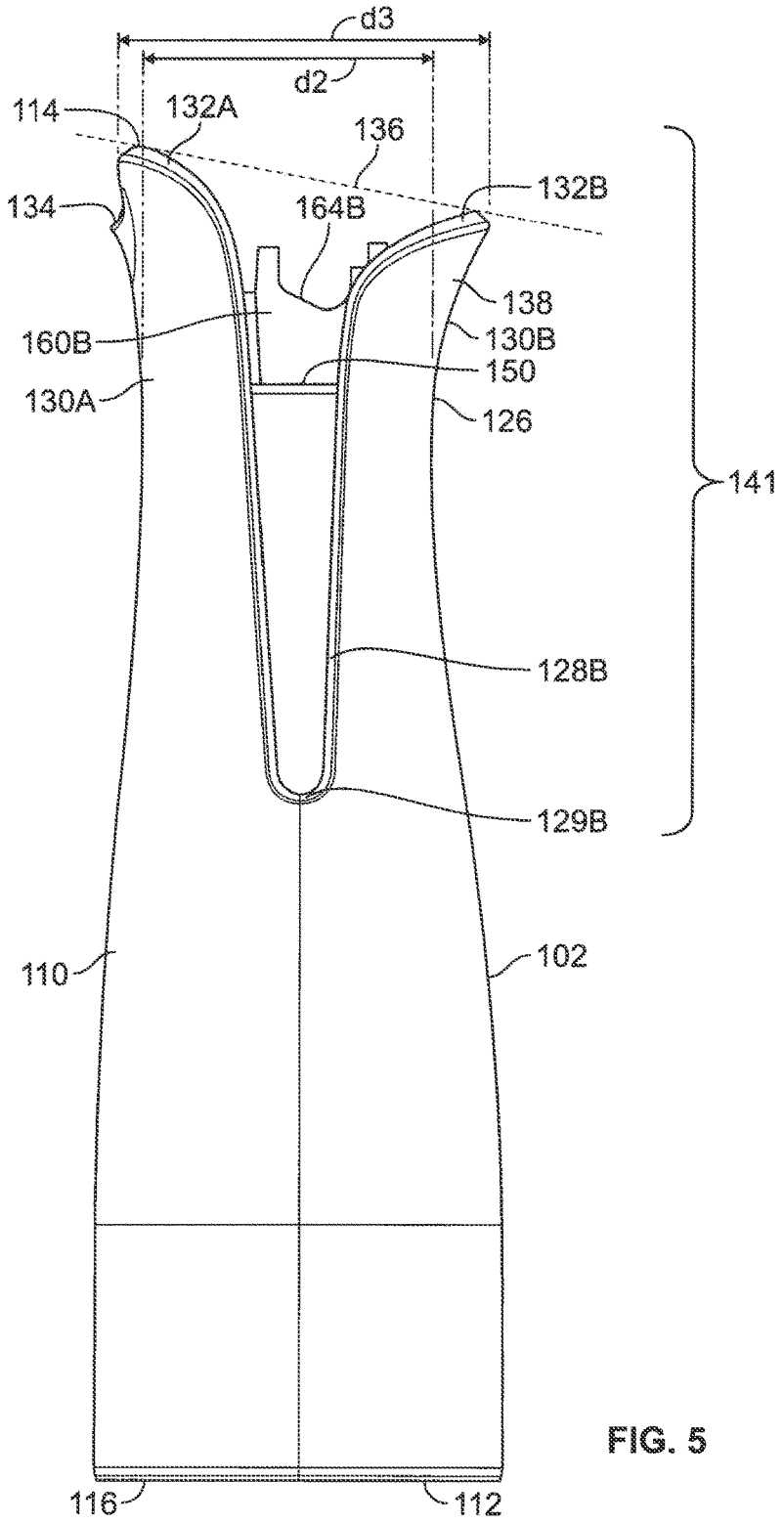
FIG. 5 is a right side elevational view of the shroud of FIG. 1, the left side being a mirror image thereof.
Figure 6:
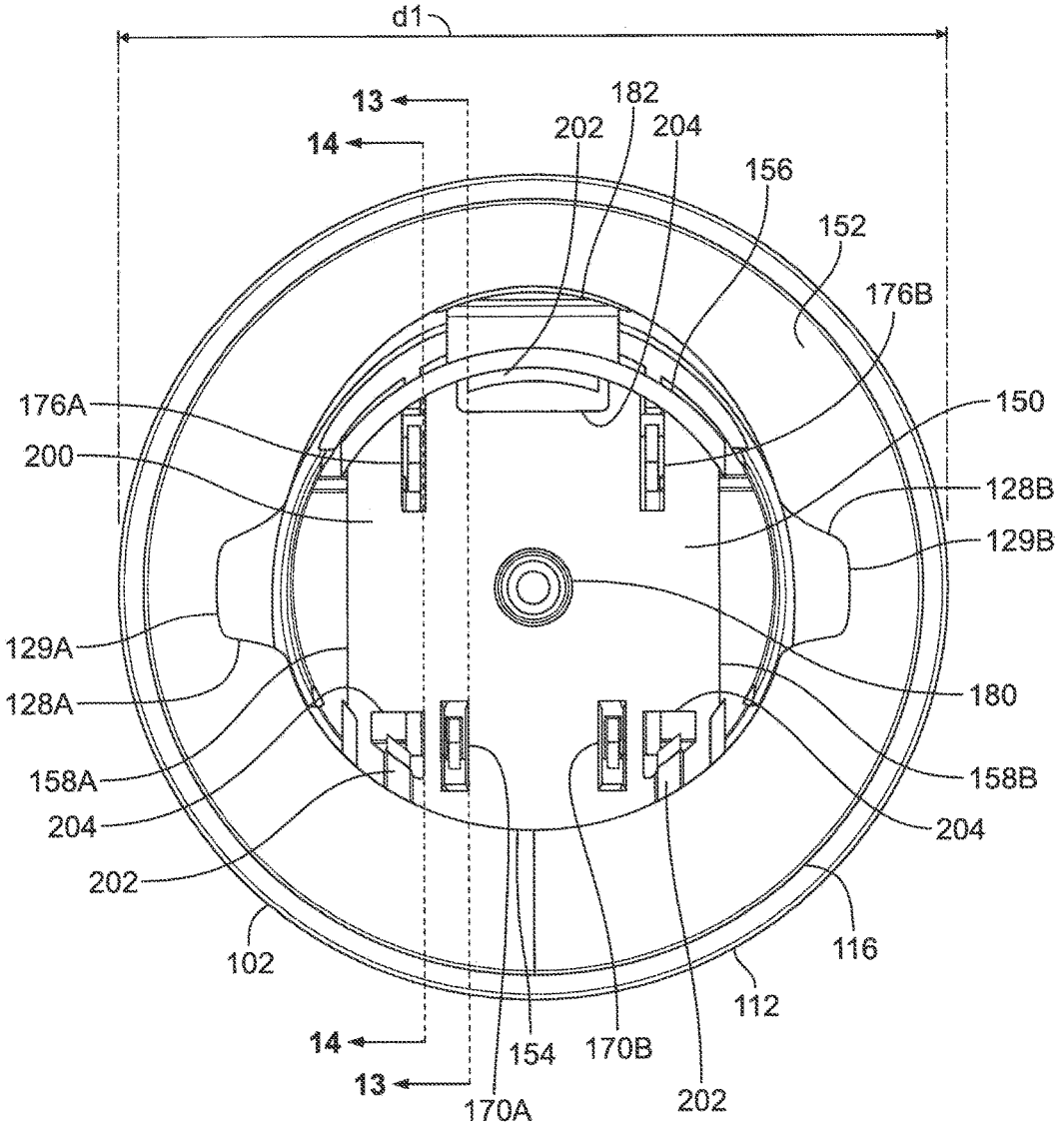
FIG. 6 is a bottom elevational view of the shroud of FIG. 1.

Referring more particularly to FIG. 6, the sidewall 110 of the shroud 102 is defined by a first diameter d1 at the bottom edge 112. In one example, the diameter d1 is about 6.3 cm (about 2.5 inches). As best seen in FIGS. 3-5, the sidewall 110 tapers inwardly from the bottom edge 112 upwardly in the direction of the longitudinal axis 122 until reaching an inflexion point 126 spaced between the bottom and top edges 112, 114, respectively. The shroud is defined by a length L2 defined from the bottom edge 112 to the top edge 114 of the shroud 102 along the longitudinal axis 122 (see FIGS. 2 and 16A). In one embodiment, the shroud 102 is between about 10 cm to about 40 cm in length, and more preferably between about 15 cm to about 25 cm in length, and most preferably between about 20 cm to about 23 cm in length. Referring more particularly to FIG. 5, the shroud 102 is further defined by a second diameter d2 at the inflexion point 126. In one example, the diameter d2 is about 5.1 cm (about 2.0 inches). In a further example, a ratio between d1 and d2 is between about 5:3 to about 5:4. The sidewall 110 of the shroud 102 tapers outwardly from the inflexion point 126 toward the top edge 114 of the shroud. In FIG. 5, the shroud 102 is defined by a third diameter d3 proximate the top edge 114 thereof. In one example, the diameter d3 is about 5.6 cm (about 2.2 inches).

First and second generally U-shaped cutouts 128A, 128B are disposed on opposing sides of the shroud 102 and delineate the shroud into a first wing 130A and a second wing 130B (see, e.g., FIG. 5). For purposes of the present disclosure, the term cutout generally defines one or more spaces, apertures, slots, or overriding surfaces, which generally define the absence of space that allows for the movement of one or more actuating surfaces. A surface area of the first and second wings 130A, 130B is defined as the area between first and second lower ends 129A, 129B of the first and second cutouts 128A, 128B, respectively, and the top edge of the shroud 114. The first and second wings 130A, 130B are further defined by length portions extending from the first and second lower ends 129A, 129B toward the top edge of the shroud 114. Each wing 130A, 130B includes a rounded top edge 132A, 132B, respectively, and the first wing 130A further includes a generally U-shaped notch 134 defined in the top edge 132A thereof. In one embodiment, the U-shaped notch 134 is configured to accept an outlet of the manifold 106 through which fluid material is dispensed. In other embodiments, the first and second wings 130A, 130B, the cutouts 128A, 128B, and/or the notch 134 can be any suitable shape or size without departing from the spirit of the present disclosure.

Referring more particularly to FIG. 5, the first wing 130A extends farther along the central axis 122 than the second wing 130B. However, in other embodiments, the second wing 130B may extend farther than the first wing 130A or the wings 130A, 130B may extend the same length. In the embodiment of FIG. 5, the difference in height between the first and second wings 130A, 130B results in an inclined tangential line 136 between the rounded top edges 132A, 132B. The inclined tangential line 136 provides an intuitive indication to a user of a spray direction angled up and away from the U-shaped notch 134.

FIG. 5 further illustrates that the second wing 130B includes a more severely curved portion 138 disposed below the top edge 132B as compared to the first wing 130A. In addition, the U-shaped cutouts 128A, 128B in the shroud 102 provide gently curved or generally planar portions 140A, 140B (see, e.g., FIGS. 3 and 4). The curved portion 138 and the generally planar portions 140A, 140B are adapted to be used as an intuitive gripping portion 141 during use of the dispensing system 100. The surface area of the gripping portion 141 is the area of the shroud 102 between the first and second lower ends 129A, 129B of the cutouts 128A, 128B, respectively, and the top-edge 114 of the shroud 102. In one example, in use, a user's hand grasps the dispensing system such that the curved portion 138 rests generally in the user's palm, portions of the user's fingers wrap around one of the generally planar portions 140A, 140B with the user's thumb wrapped around the other generally planar portion, and the remaining portions of the user's fingers wrap around the first wing 130A.

In the present embodiment, the curved portion 138 and/or the generally planar portions 140A, 140B provide a comfortable gripping portion 141 that invites a user to pick up the dispensing system 100 and squeeze the shroud 102 to dispense a liquid. Experimental testing has shown that users overwhelmingly prefer the present embodiment over prior designs because the dispensing system 100 feels comfortable being held in the user's hand, i.e., the tapered shroud 102 accommodates various sized hands of users not found in previous designs. Further, testing has shown that users prefer the ability to grip the dispensing system 100 anywhere about the shroud 102, which allows users to easily and naturally pick up and actuate the device without the need to re-orient a hand and/or finger(s) to a specific button or trigger such as found in prior devices. In addition, because a user can simply and comfortably grip and squeeze the shroud using multiple fingers in combination with their thumb and palm, the force/pressure necessary to actuate the system 100 is more evenly distributed across the user's hand and the overall force to actuate the system per unit area of the user's hand in contact with the shroud is reduced over other trigger/button actuated systems.

The dispensing systems disclosed herein are provided with one or more actuation areas in the form of actuating members or portions that provide for the above-noted advantages. Squeezing, depressing, pulling, pivoting, or otherwise actuating the one or more actuation areas provides for the dispensing of fluid from the dispensing system. In a preferred embodiment, a surface area of the actuation area is preferably between about 15% to about 95% of the surface area of a gripping portion, and more preferably between about 40% to about 85% of the surface area of the gripping portion, and most preferably between about 40% to about 50% of the surface area of the gripping portion. In another preferred embodiment, the actuation area has a surface area between about 10% to about 95% of a surface area of the shroud, and more preferably between about 25% to about 95% of the surface area of the shroud. In still another preferred embodiment, the actuation area has a length dimension L3 of between about 20% to about 90% of the length L2 of the shroud, and more preferably between about 40% to about 60% of the length L2 of the shroud, as measured about a longitudinal axis of the dispensing system. In a particular embodiment, the length of the at least one actuation member is between about 5 cm to about 40 cm and the length of the shroud is between about 10 cm to about 80 cm. For example, turning to FIG. 16A, in one embodiment the length L3 of the actuation area (or first wing 130A) extends between a lower perimeter A and the top edge 114 of the shroud 102 and has a length of about 9 cm about the longitudinal axis 122 and a length L2 of the shroud of about 22 cm about the longitudinal axis. Therefore, in the present embodiment the actuation area length L3 is about 40% of the length L2 of the shroud 102.

It is understood that the actuation area of an actuating member or portion comprises the total outer surface area of the member or portion that may be contacted by a user to effect emission of fluid from a dispensing system. In embodiments that utilize hinging or pivoting members, the actuation area is measured from the section of rotation to the outer peripheral bounds of the member or portion. In some embodiments one actuation area may be provided. In other embodiments, the actuation area may comprise two or more members or portions. In still other embodiments, a single actuation member or portion is provided in conjunction with a non-actuable member or portion.

It is also understood that the gripping area of a dispensing system comprises the total surface area of a shroud, sleeve, housing, or other retention structure that is grippable by a user for actuating the system. More particularly, the gripping areas of the dispensing systems are bounded by a lower perimeter that circumscribes the retention structure and an upper perimeter that extends about a top end of the retention structure. The lower perimeter may be generally depicted as a line that circumscribes the retention structure, e.g., see line A in FIG. 16A, adjacent an area bounding the lowermost portions of the actuation area(s). Similarly, the upper perimeter may be generally depicted as a line that circumscribes the retention structure about the top edge of the retention structure. In determining the total gripping surface, the area bounded by the lower and upper perimeters should be assumed to be uninterrupted, i.e., apertures, grooves, cutouts, or any other interruptions, should not be eliminated from the surface area calculation.

Figure 16A:
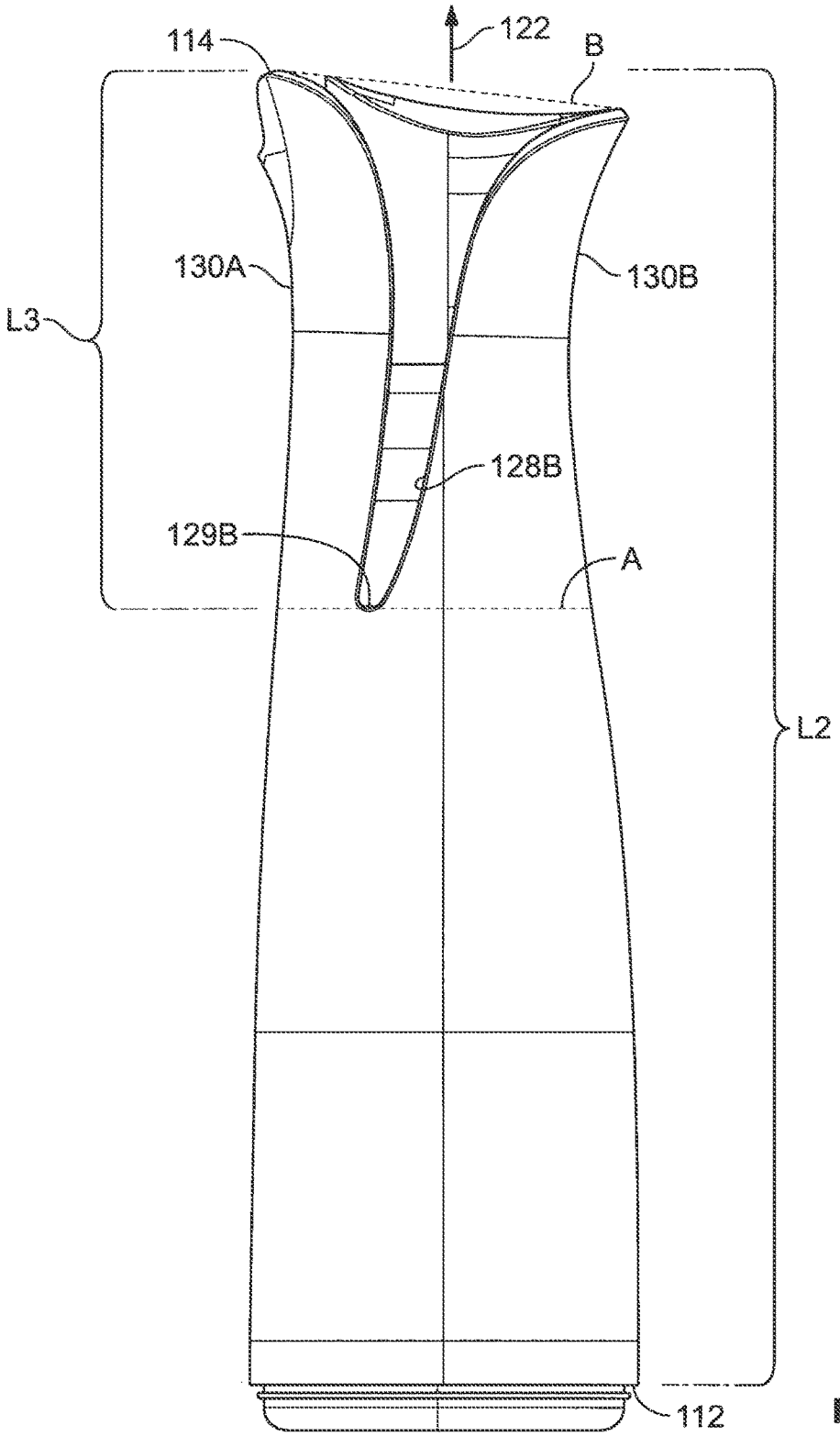
FIG. 16A is an isometric view of an additional embodiment of a dispensing system, wherein no portion of a container is visible beneath a bottom edge of a shroud.
Figure 16E:
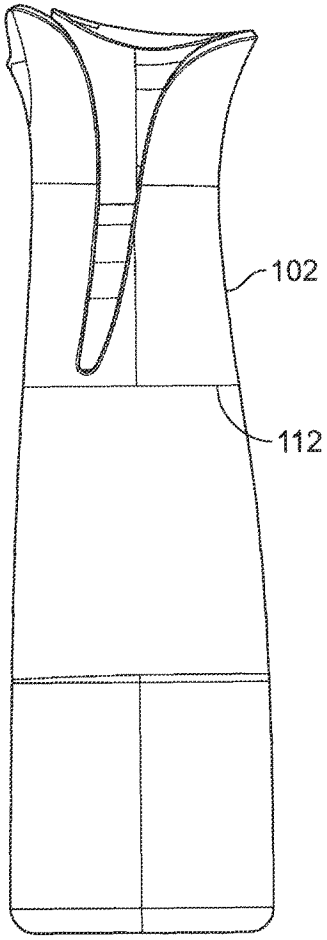
FIG. 16E is an isometric view of an additional embodiment of a dispensing system, wherein about 70% of a container is visible beneath a bottom edge of a shroud.
Figure 16D:
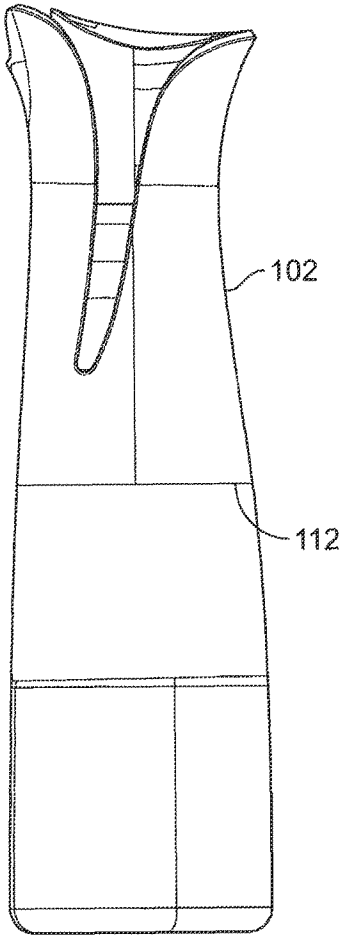
FIG. 16D is an isometric view of an additional embodiment of a dispensing system, wherein about 60% of a container is visible beneath a bottom edge of a shroud.
Figure 16C:
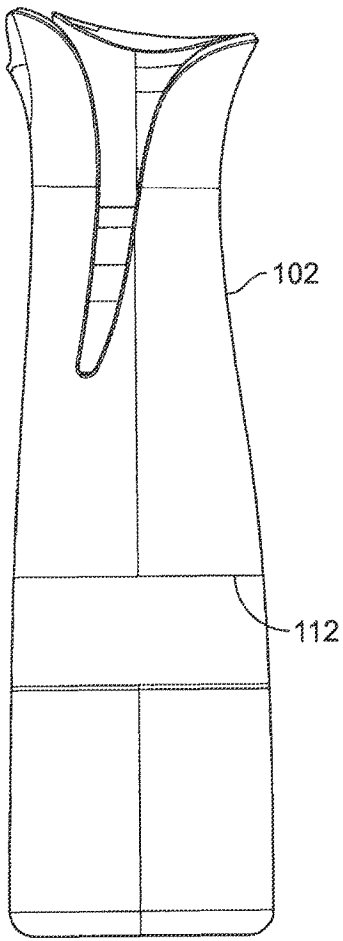
FIG. 16C is an isometric view of an additional embodiment of a dispensing system, wherein about 50% of a container is visible beneath a bottom edge of a shroud.
Figure 16B:
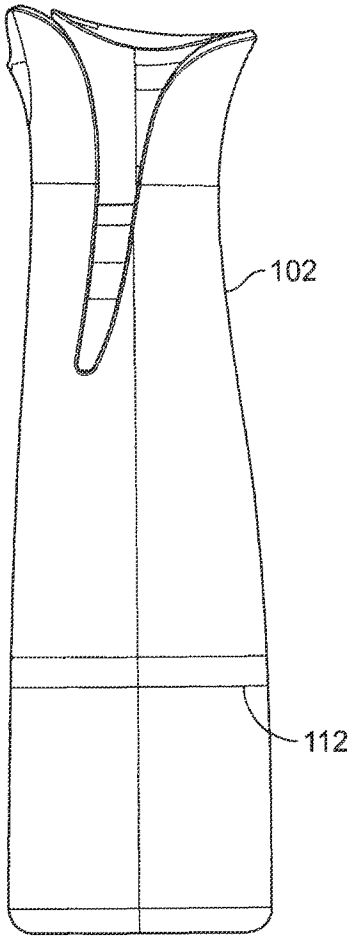
FIG. 16B is an isometric view of an additional embodiment of a dispensing system, wherein about 25% of a container is visible beneath a bottom edge of a shroud.
Figure 17:
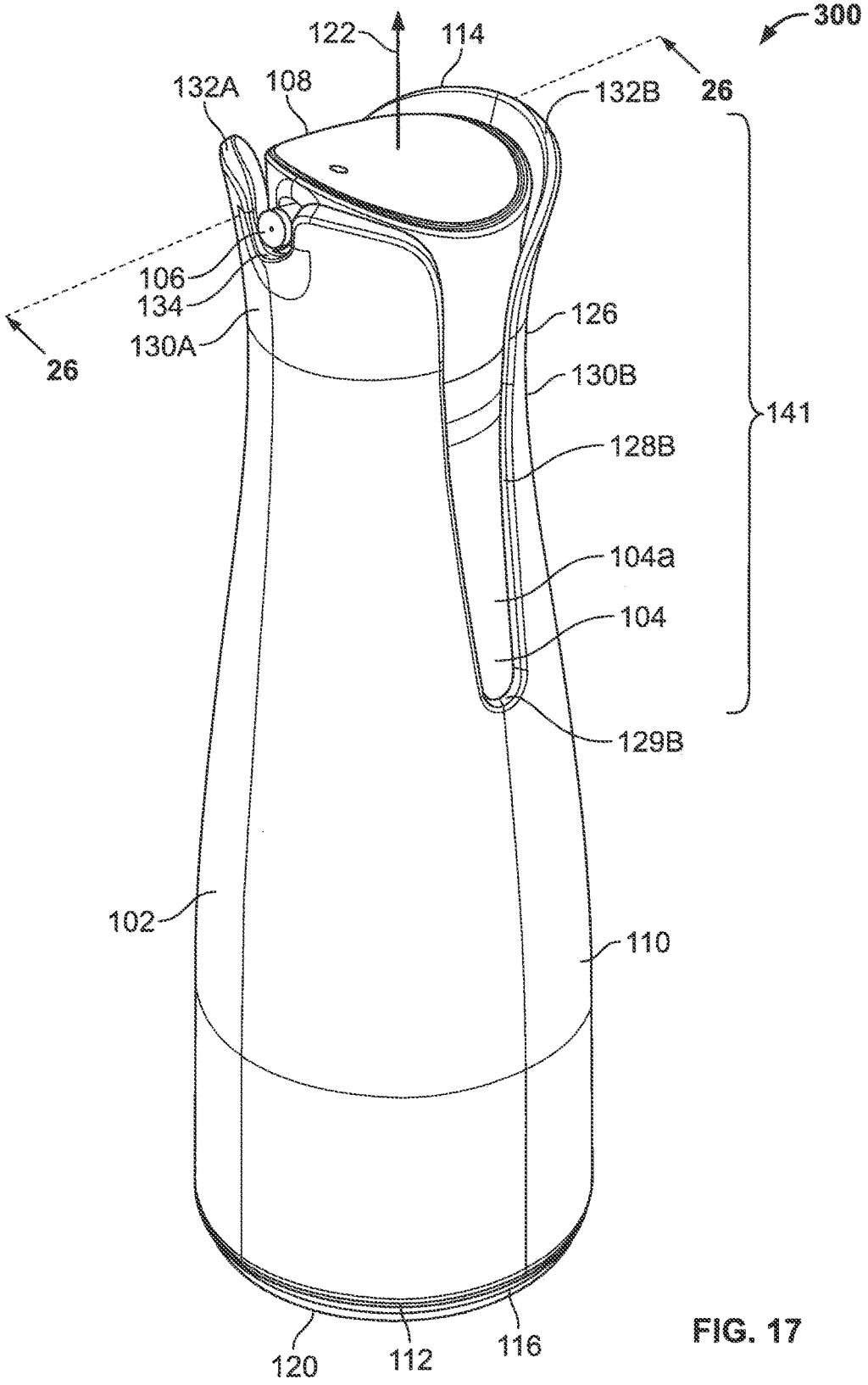
FIG. 17 is an isometric view of a top, front, and a right side of an additional embodiment of a dispensing system similar to the one depicted in FIG. 1.

In connection with the dispensing system depicted in FIG. 16A, the actuation area is generally shown as comprising one or more wings 130A, 130B. While the present embodiment discloses rotational movement of only the first wing 130A, it is contemplated that one or more of the first and second wings 130A, 130B could be modified for rotation, depression, lateral actuation, sliding, or any other type of movement to cause activation of the dispensing system. As previously noted, the surface area of the first and second wings 130A, 130B are bounded by a lower perimeter (see generally line A on FIGS. 16A and 33) adjacent the first and second lower ends 129A, 129B of the first and second cutouts 128A, 128B. The remaining portions of the first and second wings 130A, 130B between the lower perimeter and peripheral edges of the respective wings 130A, 130B provide the surface area thereof. The surface area of the gripping portion 141 is defined as the total surface area of the shroud 102 between the lower perimeter A and an upper perimeter (shown generally as line B on FIGS. 16A and 33). More specifically, the gripping portion 141 is calculated as if the surface area of the shroud 102 were uninterrupted. In the present embodiment, the surface area of removed portions of the shroud, e.g., the cutouts 128A, 128B and the U-shaped notch 134, would not be omitted from the calculation of the gripping area 141. With respect to the first wing 130A, the actuation area is about 40% of the surface area of the gripping portion 141. In connection with an embodiment where the second wing 130B is rotatable, the actuation area is about 50% of the surface area of the gripping portion 141. Finally, in connection with an embodiment where both the first and second wings 130A, 130B are rotatable to actuate the device, the actuation area is about 85% of the surface area of the gripping portion 141. In one particular embodiment depicted in FIG. 16A, the surface area of the gripping portion is about 94.97 $cm^2$ (14.72 $in^2$), the surface area of first wing 130A is about 37.10 $cm^2$ (5.75 $in^2$), and the surface area of the second wing 130B is about 44.97 $cm^2$ (6.97 $in^2$).

Figure 33:
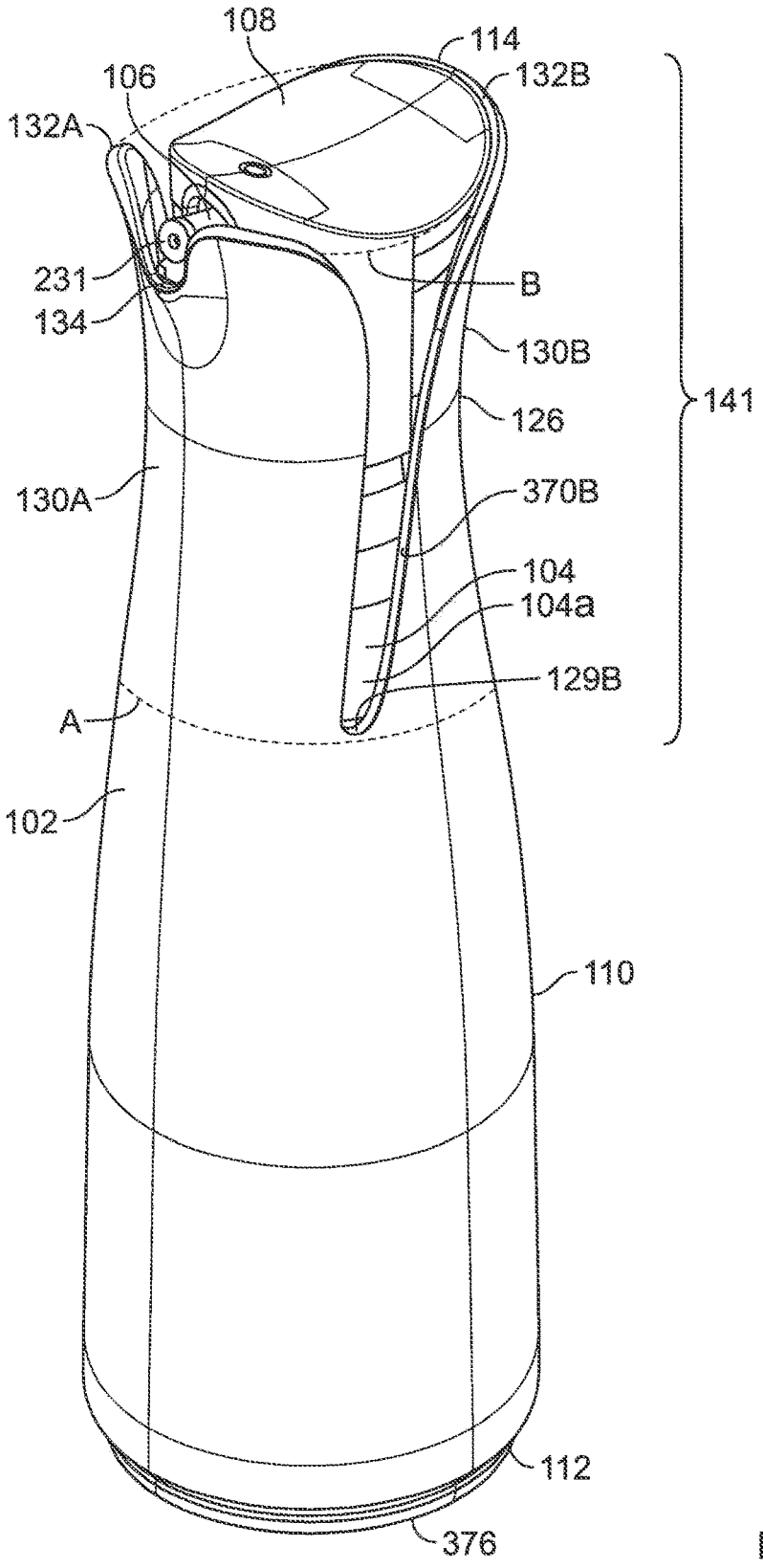
FIG. 33 is an isometric view of a further embodiment of the dispensing systems of FIG. 1 or 17.

The actuation areas of the disclosed dispensing systems also have the unique advantage of reducing the force necessary to actuate the systems per unit area of the user's hand. This advantage is realized by the relatively larger surface area of the present actuation areas over prior art trigger/button systems that utilize smaller actuation surfaces. In the embodiments described herein, a greater actuation area provides for increased user interaction by utilization of a greater portion of a user's hand during actuation. For example, FIGS. 16A and 33 depict a dispensing system that has an actuation force of about 5.90 kg (13 lbs). The average user is able to apply 3 or 4 fingers to the actuation area of the present system, i.e., the first wing 130A, to activate the device, thereby resulting in an average force per finger of between about 22 kPa (3.25 psi) to about 30 kPa (4.33 psi). It has been found that having an average force per finger of less than about 31 kPa (4.5 psi) provides a low force profile that will activate the dispensing system and be comfortable to users. Further, as was previously noted the surface area of the first wing 130A is about 37.10 $cm^2$ (5.75 $in^2$), which results in a force of about 158 $g/cm^2$ (2.26 psi) across the actuation area of the present dispensing system. It has also been found that having a force of less than about 204 $g/cm^2$ (2.90 psi) provides a low force profile that will activate the dispensing system and be comfortable to users. In contrast, commercial devices on the market have significantly higher average forces across their actuation surfaces. For example, an aerosol dispensing system sold under the trade name Febreze® Air Effects®, by The Procter and Gamble Company, has an actuation force of about 5 kgs (11 lbs). The average user of this device uses 1 or 2 fingers to trigger an actuation surface of about 4.13 $cm^2$ (0.64 $in^2$), which results in an average force per finger between about 40 kPa (5.5 psi) to about 76 kPa (11 psi) and a force of about 1208 $g/cm^2$ (17.19 psi) across the actuation surface. Similarly, another commercial aerosol dispensing system sold under the trade name Air Wick® Air Freshener, has an actuation force of about 2.72 kg (6 lbs). The average user of this device uses 1 finger to trigger an actuation surface, i.e., a vertically actuable button, of about 2.45 $cm^2$ (0.38 $in^2$), which results in an average force per finger of about 41 kPa (6 psi) and a force of about 1110 $g/cm^2$ (15.79 psi) across the actuation surface.

Further, during experimental testing, users indicated that the present dispensing system 100 does not remind them of conventional prior art designs, which resulted in the user being more prone to leave the dispensing system out in plain sight when not in use. It has been found that the user's perception of the attractiveness of dispensing system designs is based, at least in part, on avoiding the conventional approximately 30/70 proportion of caps to containers, respectively, found in prior art dispensing systems. More particularly, testing has shown that increasing the proportion of the cap or shroud that is visible compared to portions of the container that are visible provides a more attractive and preferred design that consumers are more likely to leave out in plain sight, e.g., a living room, a kitchen, a bathroom, or an office, than other dispensers, which are hidden by consumers, e.g., in a cabinet or underneath a sink. Further, it was found by analyzing the results of the testing that increasing the proportion of the shroud that is visible to over fifty percent of the dispensing system provides a significant and surprising increase in user preference over designs that increase the proportion of the cap that is visible between thirty and fifty percent. Further, increasing the proportion of the cap that is visible beyond fifty percent toward one hundred percent resulted in an even greater, non-linear, increase in user preference.

In another test, users were presented with the dispensing systems 100A-100E depicted in FIGS. 16A-16E, which includes a shroud 102 that covers about 100%, 75%, 50%, 40%, and 30% of the length of the container 104, respectively, as measured from the bottom edge 112 of the shroud 102. The users rated the various dispensing systems 100A-100E based on which dispensing system 100A-100E the user's liked the most and that they were most likely to leave out in plain sight. As previously noted, it was traditionally thought that users would increasingly like shrouds that covered a greater extent of a container in a linear manner from 70% exposure to 0% exposure. However, the results of a sampling of 93 users resulted in users liking shrouds that exposed 70% of containers more than those that exposed only 50% of a container. In contrast, there was no significant difference in user preference between shrouds that exposed only 50% of containers as opposed to those that exposed 60% of containers. Surprisingly, as noted above, the analysis concluded that a user's desire to keep dispensing systems in plain sight was significantly higher for those systems that had shrouds that exposed only 25% of a container and 0% of a container. The initial trends for a user's intention to keep a dispensing system out in plain sight did not naturally lead to the conclusion that users would want to keep systems out that exposed 25% or less of a container. These unexpected results from the present test and prior analyses were incorporated into the design of the shroud 102 of the present disclosure to provide for greater coverage of the container 104 than prior designs. In one embodiment, the shroud 102 covers a majority of the container 104. In a preferred embodiment, about 0% to about 50% of the surface area of the sidewall 104*a* of the container 104 is visible below the bottom edge, and more preferably about 0% to about 25% of the surface area of the sidewall 104*a* of the container 104 is visible below the bottom edge.

Another benefit of the present dispensing system 100 is that the shroud 102 can be reused with a new container 104 if the old container is depleted or with different containers if a new scent is desired. In other embodiments, the shroud 102 may be adapted to be non-removably attached to the container 104.

Further, in the present embodiment, the shroud 102 does not include any distinct or visible trigger or button for dispensing the liquid. As a non-limiting example, an extending trigger or a cut-out portion within the shroud or indicia on the shroud could be considered "distinct" or "visible." Rather, a user merely grips the wings 130A, 130B and squeezes to dispense the liquid, as will be described in more detail hereinafter. The absence of any distinct or visible trigger or button has proven to be overwhelmingly preferred during experimental testing over other designs utilizing such structure.

Figure 7:
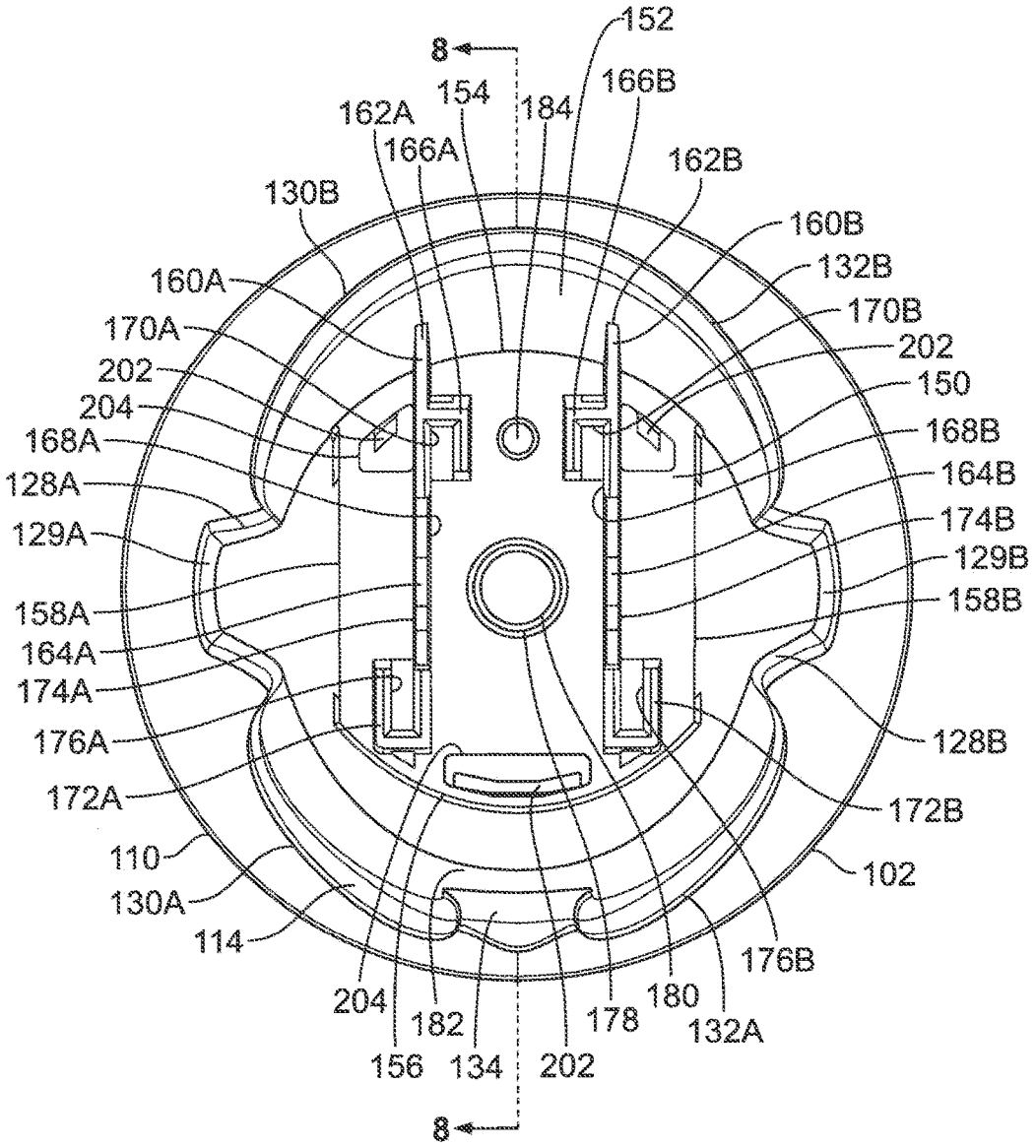
FIG. 7 is a top elevational view of the shroud of FIG. 1.
Figure 8:
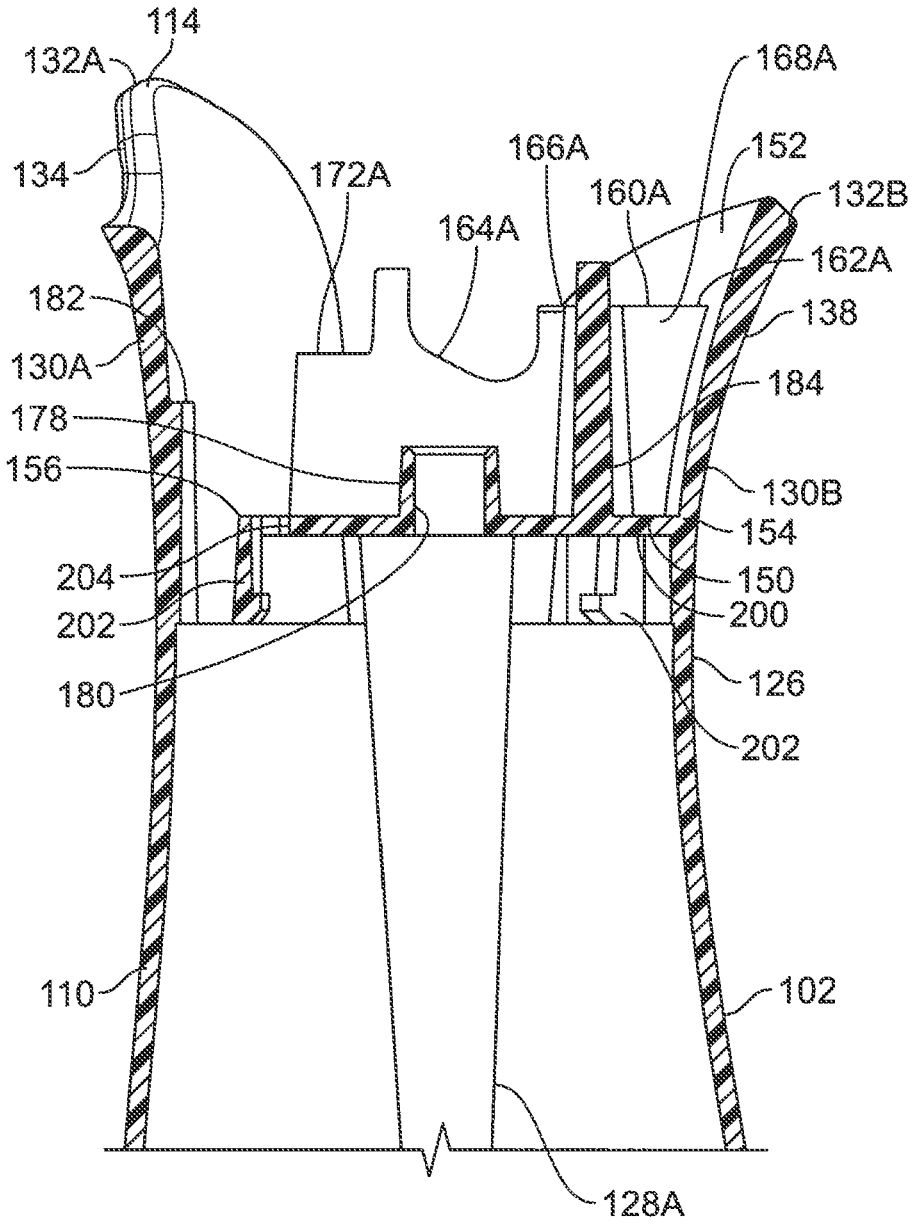
FIG. 8 is a cross-sectional view of the shroud of FIG. 1 taken generally along lines 8-8 of FIG. 7.

Referring back to FIGS. 5-8, the shroud 102 further includes a horizontal platform 150 that extends inwardly from an inner surface 152 of the sidewall 110. In the present embodiment, the horizontal platform 150 extends from the inner surface 152 adjacent the second wing 130B. However, in other embodiments, the platform 150 may extend from the first wing 130A or any other suitable portion of the shroud 102 without departing from the spirit of the present invention. Referring more particularly to FIGS. 7 and 8, the platform 150 is attached to and/or integrally formed with the sidewall 110 at a first end 154 and is unattached at a second end 156. The platform 150 is generally circular and truncated by opposing first and second planar edges 158A, 158B. First and second rails 160A, 160B, respectively, are generally parallel with respect to each other and extend upwardly from the platform 150 at locations spaced from the first and second edges 158A, 158B, respectively. Back edges 162A, 162B of the rails 160A, 160B are attached and/or are otherwise integral with the inner surface 152 of the sidewall 108.

Still referring more particularly to FIGS. 7 and 8, each rail 160A, 160B further includes a curved cutout 164A, 164B in a central portion thereof. First and second L-shaped members 166A, 166B extend from inside surfaces 168A, 168B of the rails 160A, 160B, respectively, proximate the inner surface 152. The first and second L-shaped members 166A, 166B are generally the same height as the first and second rails 160A, 160B (see, e.g., FIG. 8). First and second rectangular voids 170A, 170B are formed through the platform 150 in an area defined between the L-shaped members 166A, 166B and the inside surfaces 168A, 168B. Third and fourth L-shaped members 172A, 172B extend from outside surfaces 174A, 174B of the rails 160A, 160B, respectively, distal from the inner surface 152. The third and fourth L-shaped members 172*a*, 172*b* extend upwardly from the platform 150 to a height less than the L-shaped members 166A, 166B (see, e.g., FIG. 8). Third and fourth rectangular voids 176A, 176B are formed through the platform 150 in an area defined between the L-shaped members 172A, 172B and the outside surfaces 174A, 174B of the rails 160A, 160B.

In addition, a centrally located cylindrical wall 178 extends upwardly from the platform 150 and defines a circular opening 180 between the curved cutouts 164A, 164B in the rails 160A, 160B. Further, as seen more clearly in FIG. 8, the shroud 102 includes a stepped projection 182 that extends from the inner surface 152 adjacent the first wing 130A. The circular opening 180 and the projection 182 are adapted to support portions of the manifold 108, as will be described in more detail hereinafter with respect to FIG. 15. Still further, a generally frusto-conical column 184 extends from a central portion of the platform 150 proximate the inner surface 152.

Figure 15:
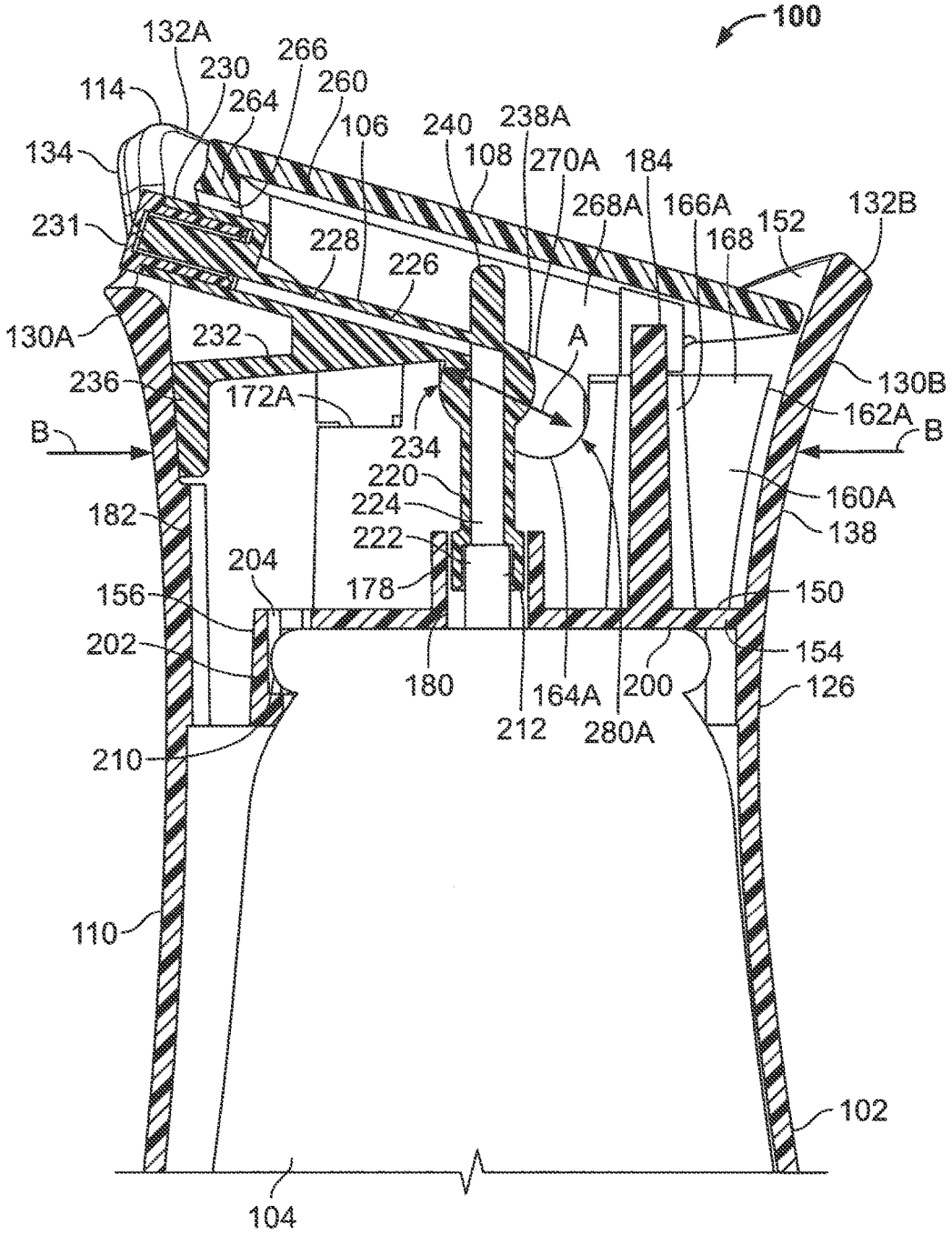
FIG. 15 is a partial cross-sectional view of the dispensing system of FIG. 1 taken generally along lines 15-15 of FIG. 1.

Now turning to FIGS. 6 and 8, a bottom side 200 of the platform 150 includes a mechanism adapted to secure the container 104 thereto. In the present embodiment, the mechanism includes a plurality of hooks 202 that extend downwardly from the platform 150. Further, a plurality of cut-outs 204 are defined in the platform proximate the hooks 202. In one embodiment, the cut-outs 204 facilitate the hooks 202 flexing outwardly around portions of the container 104 to retain the container to the shroud 102. For example, as shown generally in FIGS. 2 and 15, the container 104 can be an aerosol container that includes a mounting cup 210 and a tilt-activated or axially depressible valve stem 212 that extends from a central portion of the mounting cup. FIG. 15 illustrates an example where the hooks 202 are configured to be secured under peripheral portions of the mounting cup 210 to secure the container 104 to the shroud 102. In other contemplated embodiments, the container 104 can be selectively retained to the shroud 102 by other known means, e.g., an interference fit, adhesive, a threaded connection, a bayonet-type connection, and the like.

Figure 9:
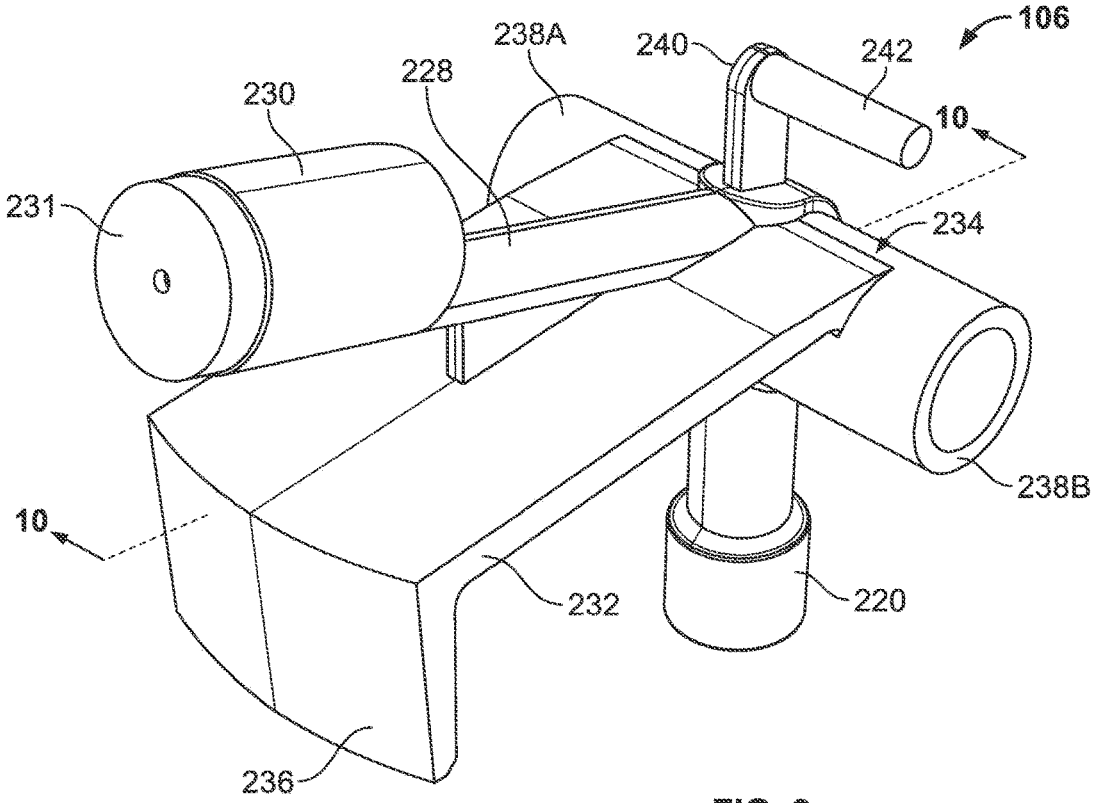
FIG. 9 is an enlarged isometric view of the manifold of FIG. 1.
Figure 10:
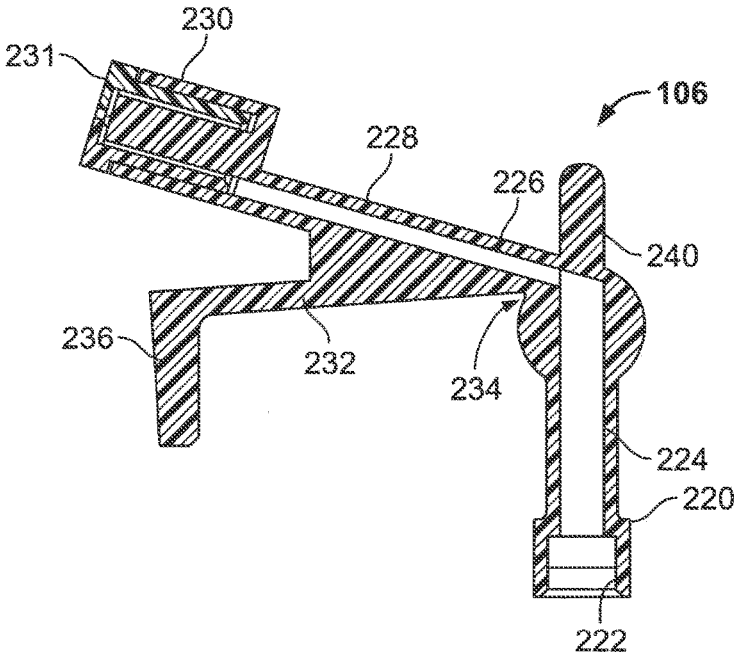
FIG. 10 is a cross-sectional view of the manifold of FIG. 9 taken generally along lines 10-10 of FIG. 9.

Referring now to FIGS. 9, 10, and 15, the manifold 106 includes a generally cylindrical base 220 that defines an opening 222 adapted to receive the valve stem 212 of the container 104. A first hollow tube 224 is defined in the base 220 and extends upwardly from the opening 202. The first hollow tube 224 is fluidly coupled to a second hollow tube 226 that is defined within an arm 228 that extends angularly away from the base 220. A discharge nozzle 230 is provided on a distal end of the arm 228 through which liquid that travels up through the first and second hollow tubes 224, 226 is ejected from the manifold 106. The discharge nozzle 230 may further include a spray insert 231, which can be easily modified and replaced, e.g., at a manufacturing facility. The discharge nozzle 230 and the spray insert 231 may be designed to facilitate the generation of different spray patterns, e.g., a spray, mist, or stream of liquid, and to modify fluid turbulence characteristics of the discharged liquid.

A horizontal shelf 232 extends outwardly from the manifold 106 proximate an intersection 234 between the base 220 and the arm 228. A wall 236 extends downwardly from a distal end of the horizontal shelf 232. Further, first and second members 238A, 238B extend outwardly from opposing sides of the manifold 106 proximate the intersection 234 between the base 220 and the arm 228. In the present embodiment the first and second members 238A, 238B are generally cylindrical. Still further, a projection 240 extends upwardly from the base 220 and includes a rod 242 extending horizontally from a distal end thereof, generally along the same direction as the cylindrical member 238B.

Figure 11:
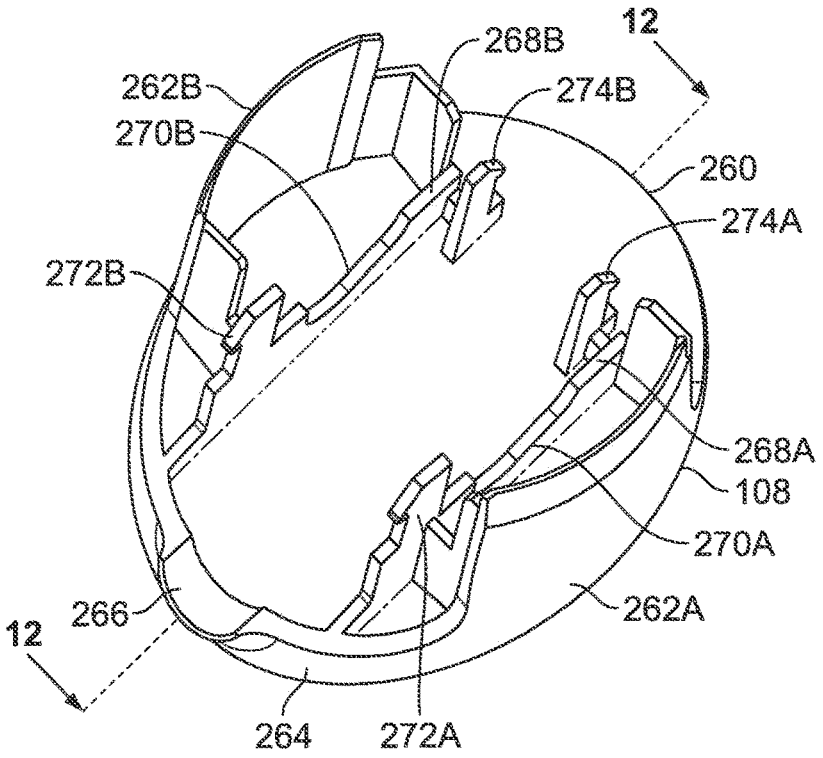
FIG. 11 is an isometric view of a bottom, front, and left side of the cap of FIG. 1.
Figure 12:
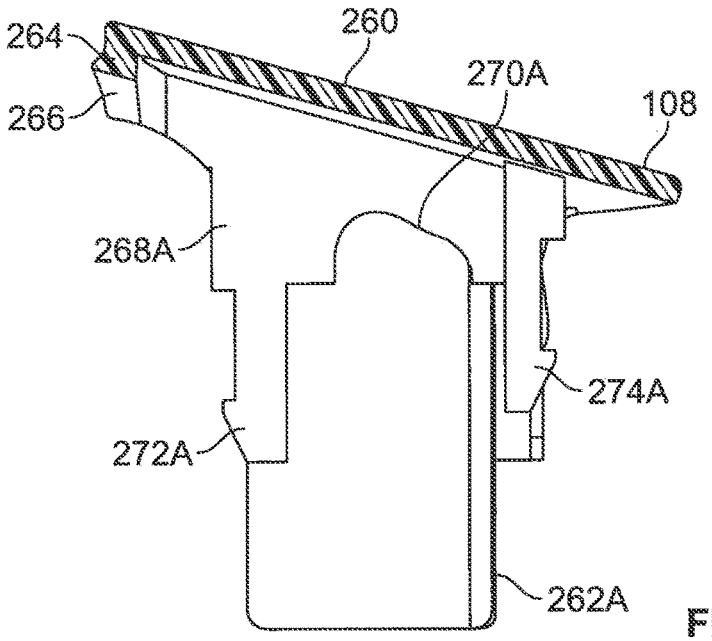
FIG. 12 is a cross-sectional view of the cap of FIG. 11 taken generally along lines 12-12 of FIG. 11.

With reference now to FIGS. 11, 12, and 15, the cap 108 includes a top wall 260, first and second opposing side walls 262A, 262B, respectively, and a front wall 264. In the present embodiment, each of the first and second side walls 262 and the front wall 264 extend from a periphery of the top wall 260 with the side walls extending substantially farther than the front wall. In one embodiment, the top wall 260 is inclined to correspond generally to the angle of the tangential line 136 between the rounded top edges 132A, 132B of the first and second wings 130A, 130B. In this embodiment, the angled top wall 260 further provides an intuitive indication to a user of a spray direction angled up and away from the U-shaped notch 134. The front wall 264 further defines a notch 266 that is configured to accept an outlet of the manifold 106, e.g., the discharge nozzle 230, and to align generally with the notch 134 of the shroud 102.

The cap 108 further includes first and second rails 268A, 268B, respectively, that are generally parallel with respect to each other and extend downwardly from the top wall 260 of the cap 108 at locations spaced from the periphery of the top wall. Each rail 268A, 268B further includes a curved cutout 270A, 270B, respectively, in a central portion thereof. First and second hook members 272A, 272B, respectively, extend from the rails 268A, 268B, respectively, proximate the front wall 264. Similarly, third and fourth hook members 274A, 274B, respectively, extend from positions inwardly spaced from the rails 268A, 268B, respectively, distal from the front wall 264. As seen more clearly in FIG. 12, the first and second hook members 272A, 272B, extend farther than the third and fourth hook members 274A, 274B.

Figure 13:
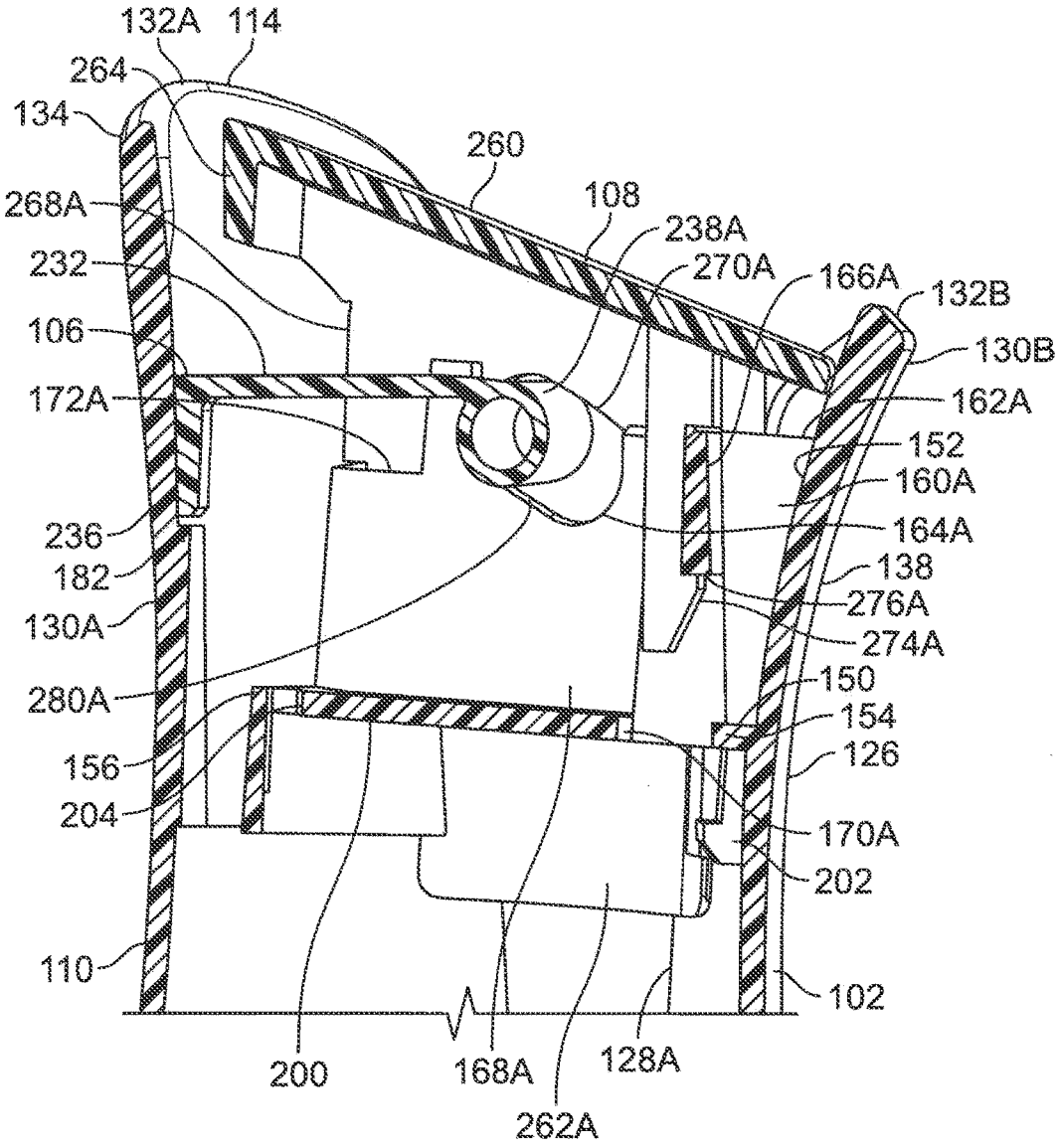
FIG. 13 is a partial cross-sectional, isometric view of a top, back, and right side of the dispensing system of FIG. 1 taken generally along lines 13-13 of FIG. 6 and including the shroud, manifold, and cap in an assembled condition.
Figure 14:
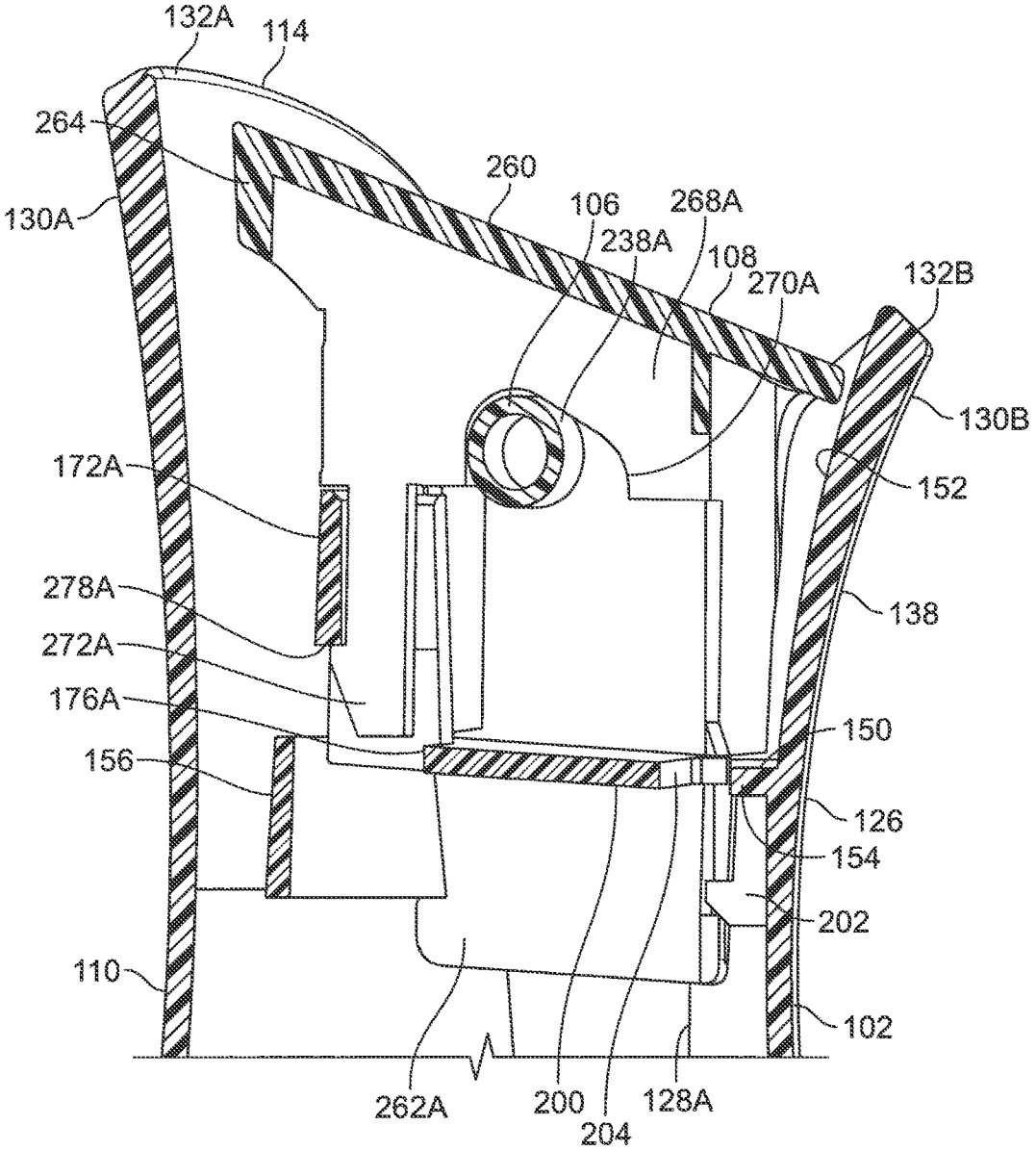
FIG. 14 is a view similar to FIG. 13 taken generally along lines 14-14 of FIG. 6.

Referring now to FIGS. 13-15, in an assembled condition, the container 104 is inserted through the opening 116 in the shroud 102 so that the hooks 202 that extend from the bottom side 200 of the horizontal platform 150 are engaged with the mounting cup 210 of the container 104 to retain same thereto and the valve stem 212 is disposed within the circular opening 180. The manifold 106 is inserted past the top edge 114 of the shroud 102 so that the opening 222 in the base member 220 is secured in the opening 180 of the horizontal platform 150 and around the valve stem 212 of the container 104. The manifold 106 is further disposed within the shroud 102 so that the horizontal shelf 232 and the downwardly extending wall 236 abut the inner surface 152 of the shroud 102 above the stepped projection 182.

The cap 108 is inserted over the manifold 106 so that the side walls 262A, 262B and the front wall 264 are disposed within the top edge 114 of the shroud 102 and the notch 266 is generally aligned with the discharge nozzle 230 of the manifold and the notch 134 of the shroud. The cap 108 is configured so that the hooks 272A, 272B are aligned with the rectangular voids 176A, 176B, respectively, and the hooks 274A, 274B are aligned with the rectangular voids 170A, 170B, respectively. Referring more particularly to FIGS. 13 and 14, the first and second L-shaped members 166A, 166B further include cutout portions 276A, 276B (only portion 276A shown in the FIG. 13, portion 276B being a mirror image thereof). Similarly, the third and fourth L-shaped members 172A, 172B further include cutout portions 278A, 278B (only portion 278A shown in the FIG. 14, portion 278B being a mirror image thereof). When the cap 108 is properly aligned with the shroud 102 and secured thereto, the hooks 272, 274 of the cap 108 engage under portions of the L-shaped members 172, 166 that define the cutout portions 278, 276. The column 184 that extends from the horizontal platform 150 of the shroud 102 provides a support structure so that the cap 108 does not damage the shroud when assembled thereon. Further, during an injection molding manufacturing process of the shroud 102, the column 184 may be formed as part of an inlet to the mold cavity.

Further, when the cap 108 is secured to the shroud 102, the curved cutouts 164A, 164B of the shroud 102 and the curved cutouts 270A, 270B of the cap 180, respectively, are generally vertically aligned and define first and second tracks 280A, 280B (only track 280A shown in the FIGS. 13-15, track 280B being a mirror image thereof). As seen more clearly in FIGS. 13 and 14, the cylindrical member 238A of the manifold 106 is disposed within the track 280A to constrain the movement of the manifold along the path of arrow A. In a mirror image arrangement, although not shown, the cylindrical member 238B is disposed within the track 280B. In addition, the projection 240 and the rod 242 of the manifold 106 interact with the top wall 260 of the cap 108 to further constrain the movement of the manifold 106 along the direction of arrow A.

In use, a user grasps the wings 130A, 130B of the shroud and exerts an inward force directed generally along the arrows B to press the wings together, which is generally perpendicular or transverse to the longitudinal axis 122 of the dispensing system 100. In the present embodiment, the container 104 is held in a relatively fixed position with respect to the second wing 130B by the hooks 202 that extend from the horizontal platform 150. When the wings 130 are pressed together, the first wing 130A moves inwardly and presses against the downwardly extending wall 236 of the manifold 106, which causes the manifold 106 to move generally in the direction of arrow A. As the manifold 106 moves back toward the second wing 130B, the valve stem 212 of the container 104 is moved in a generally radial and/or axial direction due to the coupling between the base member 220 of the manifold 106 and the valve stem 212. Consequently, the valve stem 212 is actuated and liquid is dispensed therefrom, through the first and second hollow tubes 224, 226, and out through the discharge nozzle 230. The wings 130A, 130B are designed to actuate under a force applied along the arrows B of between about 5 to about 20 pounds. The present configuration of the shroud 102 is designed so that the wings 130A, 130B can be easily grasped and squeezed by male and female consumers with hand size and strength characteristics in about the 5th to about the 95th percentile.

Turning to FIGS. 17-26, another embodiment of a dispensing system 300 is depicted, which is identical to the previously described embodiments except for the below noted differences. The dispensing system 300 includes a manifold retention system to prevent unintentional actuation of the dispensing system 300. Tilt valves and other types of valve stems may be unintentionally activated during the manufacturing and/or shipping process. In the present embodiment, the manifold retention system has been modified to hold the manifold 106 above the valve stem 212 of the container 104 until the dispensing system 300 is ready for first use, thereby preventing unintentional actuation.

Figure 18:
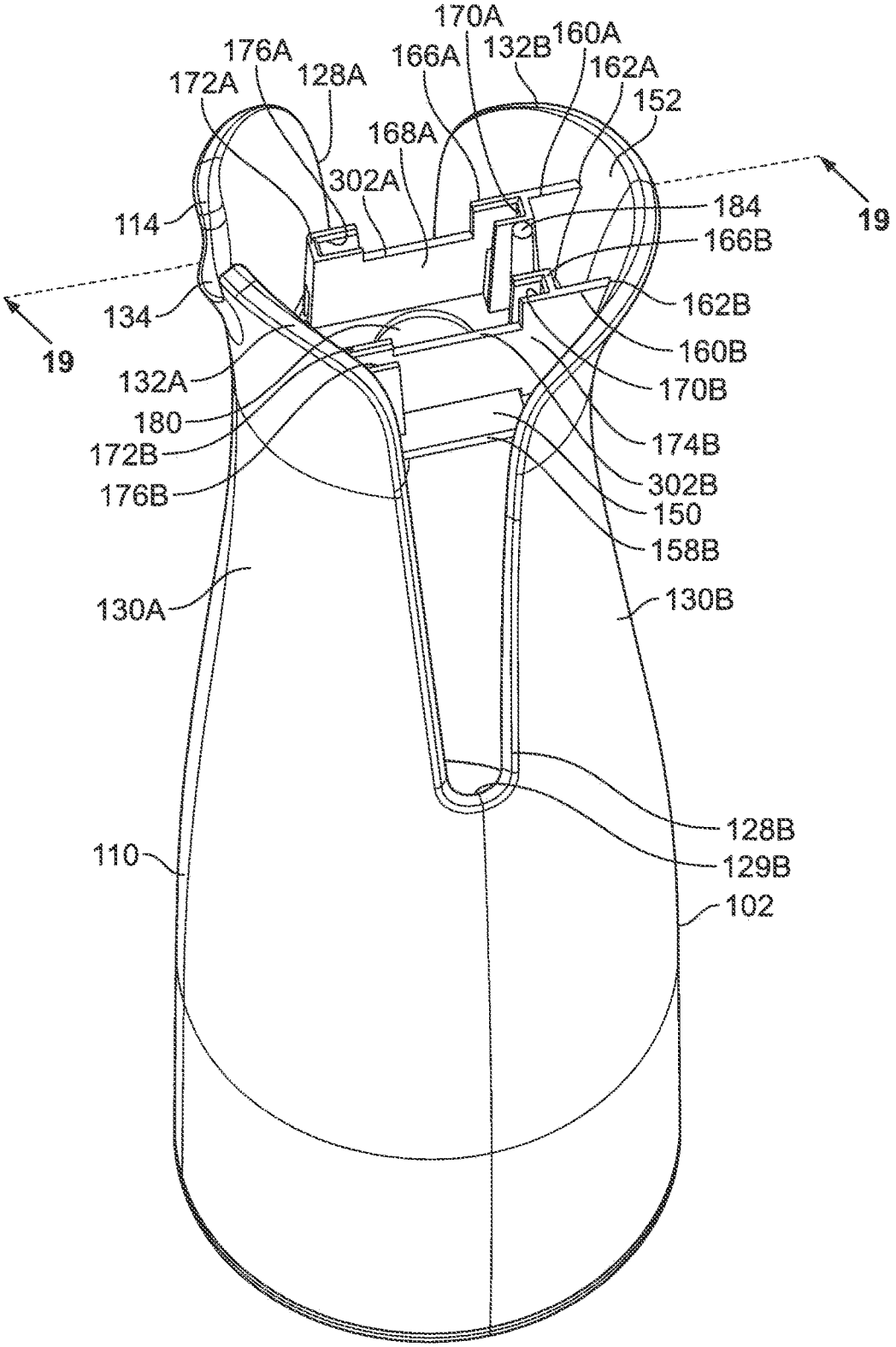
FIG. 18 is an isometric view of a top, front, and a right side of the shroud of FIG. 17.
Figure 19:
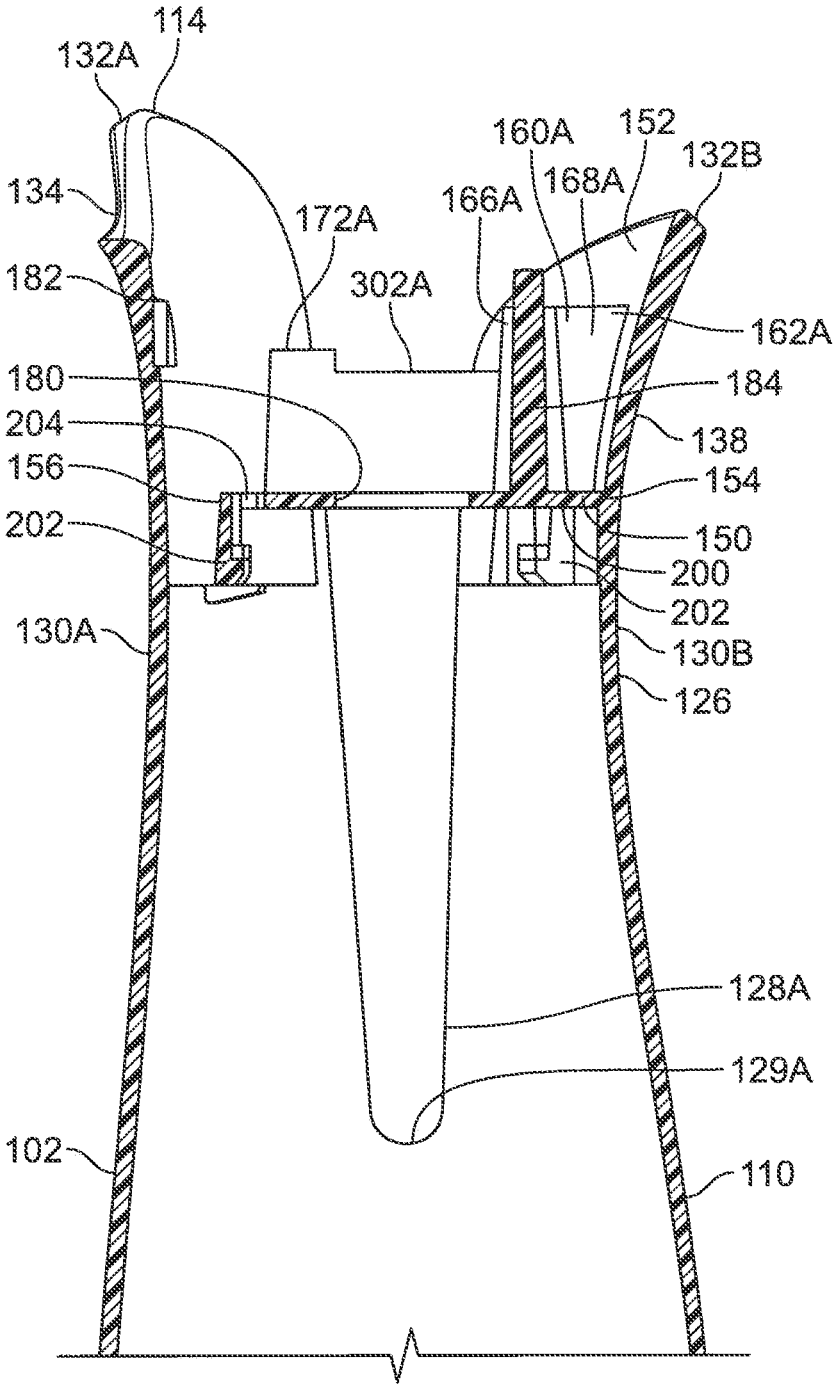
FIG. 19 is a cross-sectional view of the shroud of FIG. 18 taken generally along lines 19-19 thereof.
Figure 20:
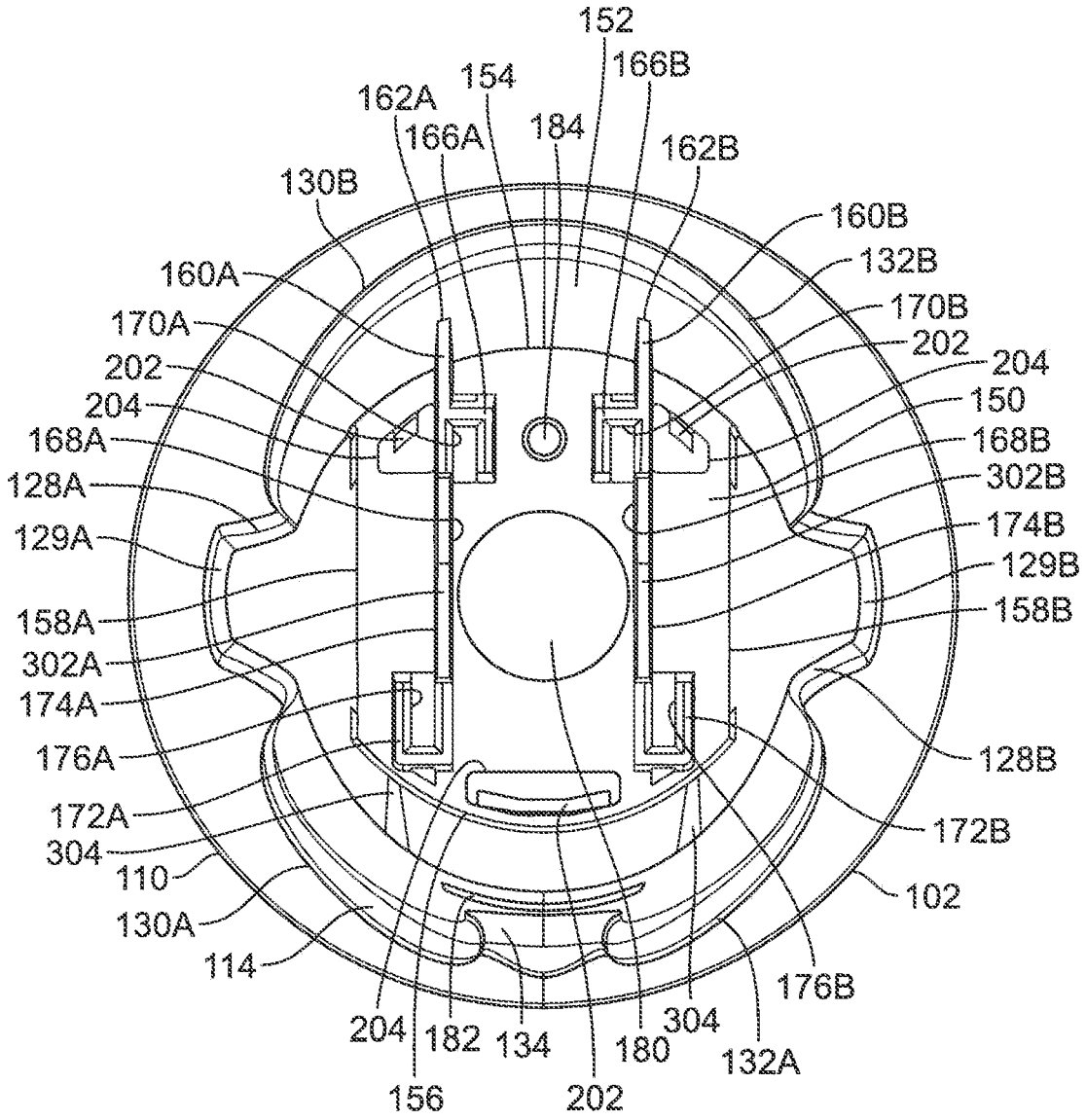
FIG. 20 is a top elevational view of the shroud of FIG. 18.

FIGS. 18-20 depict the shroud 102 of the present embodiment, which includes the horizontal platform 150. As previously noted, the horizontal platform 150 extends from the inner surface 152 of the sidewall 110 adjacent the second wing 130B. The first and second rails 160A, 160B are generally parallel with one another and extend upwardly from the platform 150 at locations spaced from the first and second edges 158A, 158B, respectively. The back edges 162A, 162B of the rails 160A, 160B are attached and/or are otherwise integral with the inner surface 152 of the sidewall 110. The first and second rails 160A, 160B include rectangular cutouts 302A, 302B, respectively, instead of the curved cutouts 164A, 164B described in connection with the previous embodiment. Additionally, the present embodiment does not include the centrally located cylindrical wall 178, which extends upwardly from the platform 150 to define the circular opening 180. Further, two protrusions 304 (see FIGS. 19 and 20) extend inwardly from the inner surface 152 of the first wing 130A to contact the bottom side 200 of the horizontal platform 150. During actuation, as the first wing 130A moves back toward the second wing 130B, the protrusions 304 ride below the horizontal platform 150 to provide additional control to the movement of the wing 130A.

Figure 21:
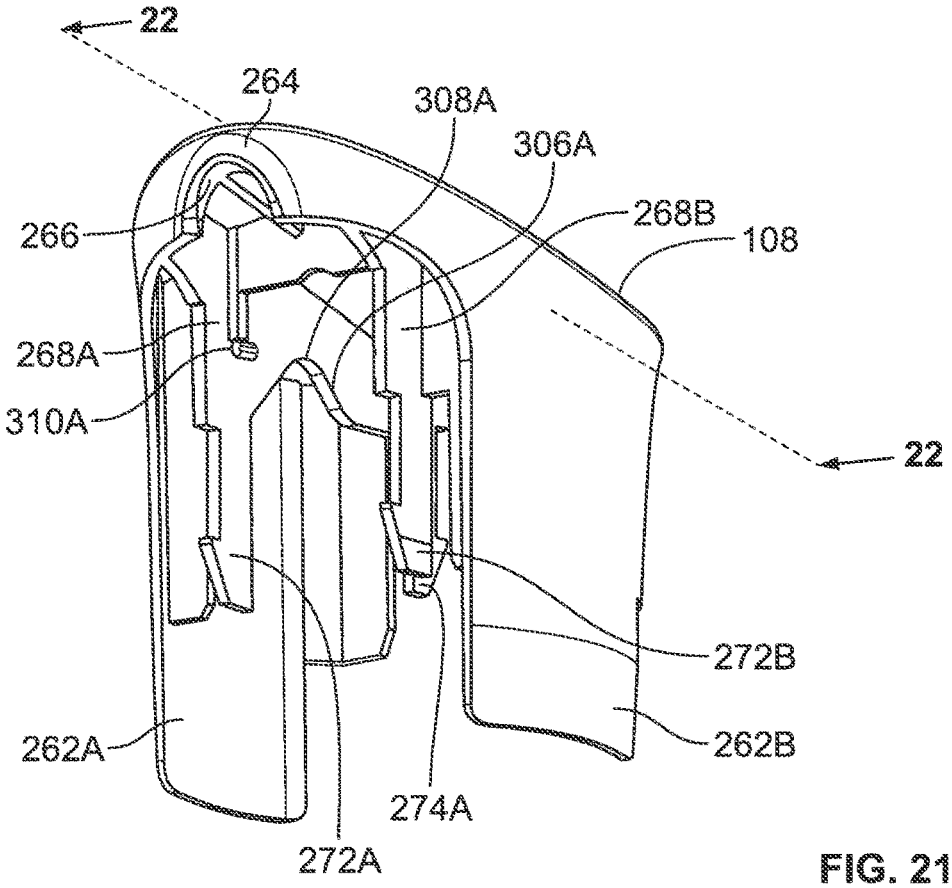
FIG. 21 is an isometric view of a front, bottom, and right side of the cap of FIG. 17.
Figure 22:
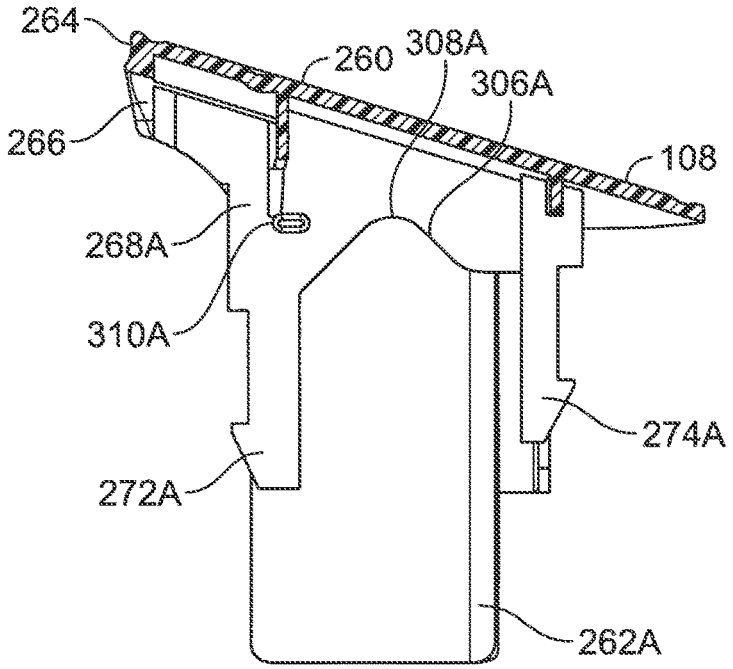
FIG. 22 is a cross-sectional view of the cap of FIG. 21 taken along lines 22-22 of FIG. 21.

FIGS. 21 and 22 depict the modified cap 108 for use in the present embodiment, which includes ramps 306A, 306B and semicircular recesses 308A, 308B within the first and second rails 268A, 268B, respectively, as opposed to the curved cutouts 270A, 270B. The semicircular recesses 308A, 308B located at the top of the ramps 306A, 306B aid in retaining the manifold 106 within the cap 108. The cap 108 also includes protrusions 310A, 310B located on the first and second rails 268A, 268B of the cap 108 (only protrusion 310A is shown in FIGS. 21 and 22, protrusion 310B being a mirror image thereof). The protrusions 310A, 310B mate with grooves 312A, 312B on the manifold 106 (see FIG. 23) and help retain the manifold 106 within the cap 108.

Figure 23:
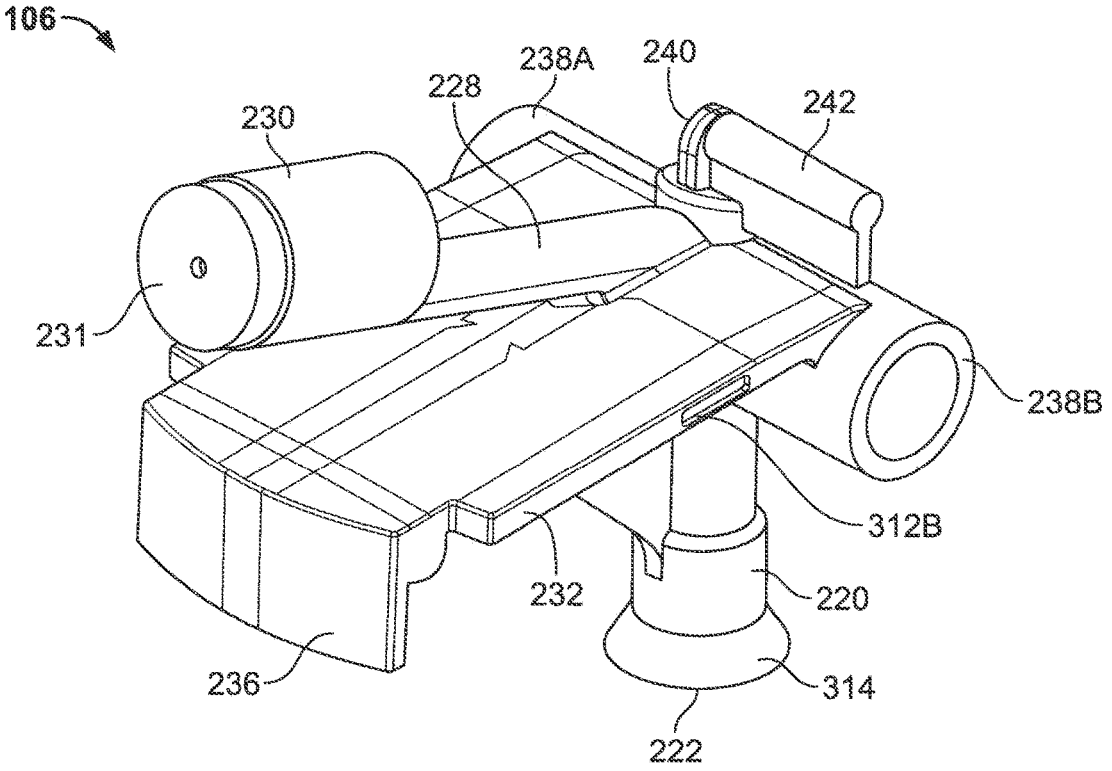
FIG. 23 is an enlarged isometric view of the manifold of FIG. 17.

FIG. 23 depicts the modified manifold 106 used in the present embodiment. The manifold 106 is provided with a conical docking base 314 attached to the end of the generally cylindrical base 220. The manifold 106 is also provided with the grooves 312A, 312B on the horizontal shelf 232 (only groove 312A is shown, groove 312B being a mirror image thereof). The grooves 312A, 312B mate with the protrusions 310A, 310B to assist in holding the manifold 106 above the valve stem 212 of the container 104.

Figure 24:
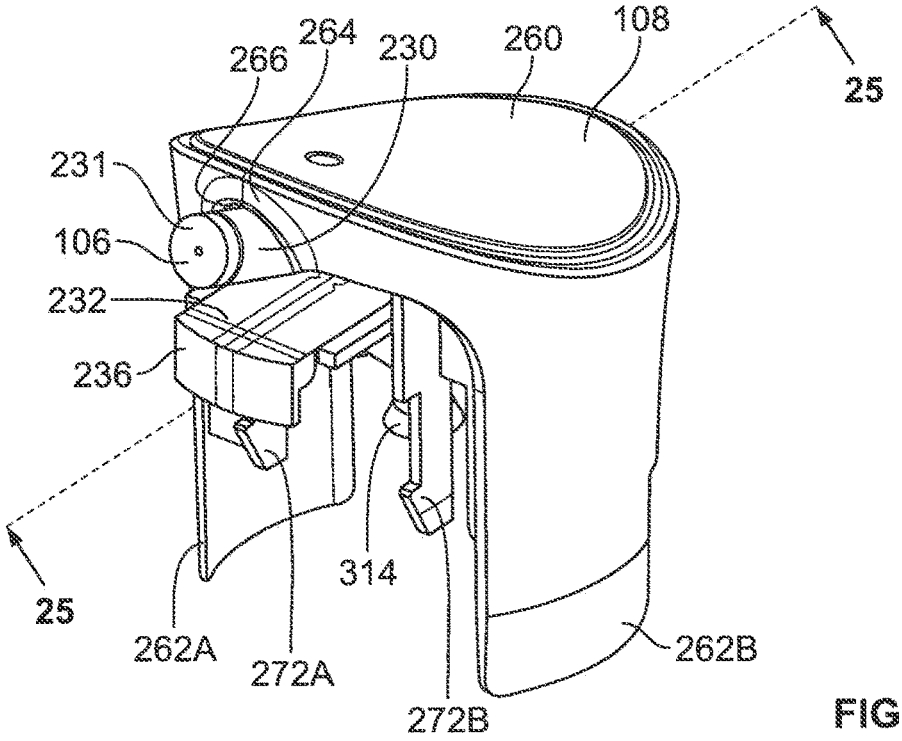
FIG. 24 is an isometric view of the top, front, and right side of the cap of FIG. 21 in combination with the manifold of FIG. 23.
Figure 25:
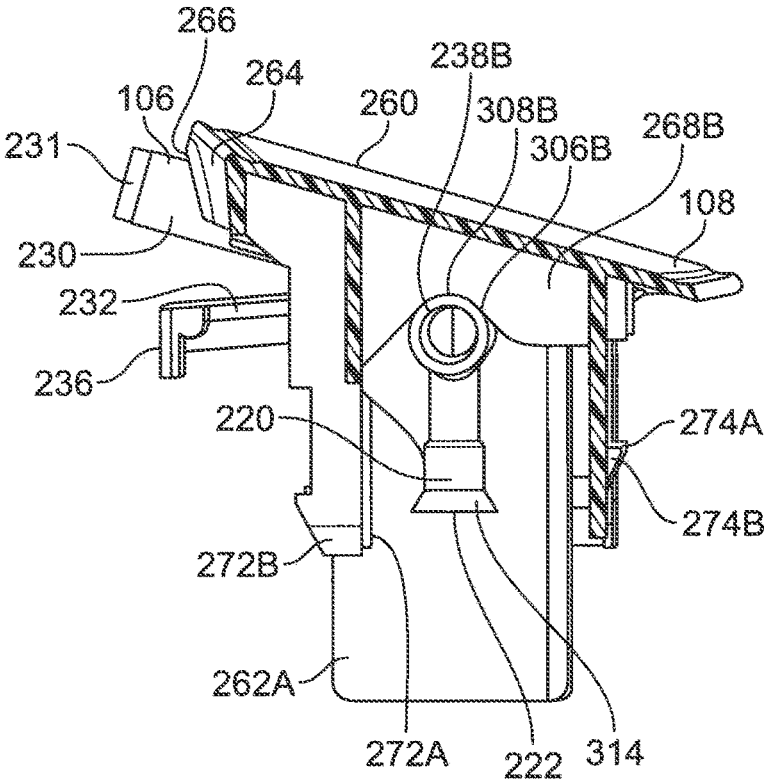
FIG. 25 is a cross-sectional view of the cap and manifold taken generally along the lines 25-25 of FIG. 24.
Figure 26:
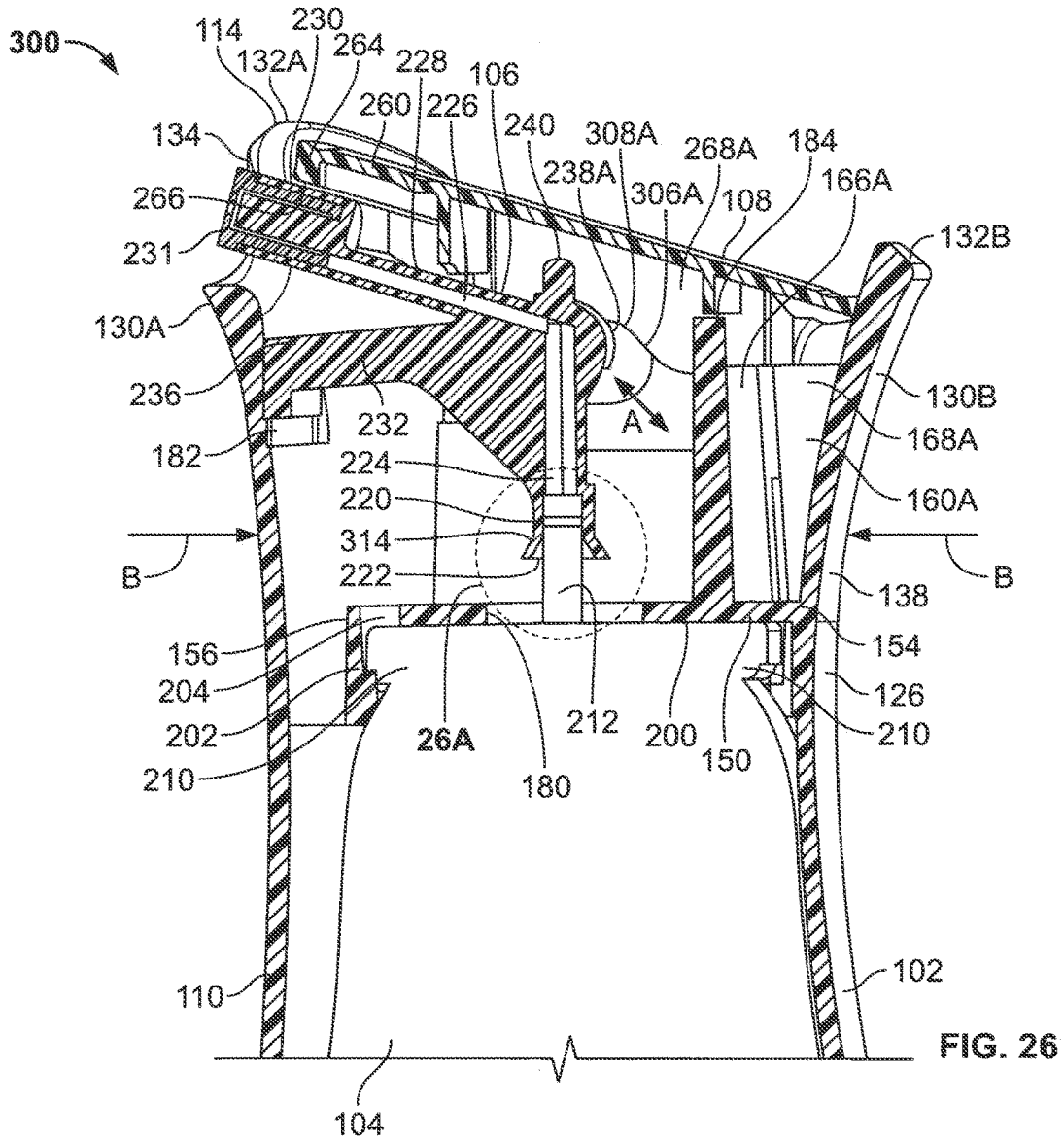
FIG. 26 is a cross-sectional view of the dispensing system of FIG. 17 taken generally along the lines 26-26 of FIG. 17.

Referring now to FIGS. 24-26, in an assembled condition, the container 104 is inserted through the opening 116 in the shroud 102 so that the hooks 202 that extend from the bottom side 200 of the horizontal platform 150 are engaged with the mounting cup 210 of the container 104 to retain same thereto and the valve stem 212 within the circular opening 180. However, unlike the previous embodiment, in the present embodiment the manifold 106 is not seated on the valve stem 212 of the container 104 during initial assembly of the dispensing system 300. Rather, the manifold 106 is inserted into the cap 108 such that the notch 266 is generally aligned with the discharge nozzle 230 of the manifold 106 and the cylindrical members 238A, 238B are nested within the semicircular recesses 308A, 308B of the cap 108. Upon insertion of the manifold 106 into the cap 108, the grooves 312A, 312B, on the manifold 106 mate with the protrusions 310A, 310B of the cap 108 to retain the manifold 106 within the cap 108 (see FIGS. 24 and 25). It is anticipated that other engagement mechanisms could be used to retain the manifold 106 within the cap 108, such as various snapping or breakaway features.

The cap 108 with the manifold 106 retained therein is then inserted into the top of the shroud 102 so that the side walls 262A, 262B and the front wall 264 of the cap 108 are disposed within the top edge 114 of the shroud 102 and the notch 266 is generally aligned with the notch 134 of the shroud 102. The cap 108 is connected to the shroud 102 in the same manner as previously described, by engaging the hooks 272A, 272B, 274A, 274B under portions of the L-shaped members 172A, 172B, 166A, 166B. Further, upon securement of the cap 108 to the shroud 102, the manifold 106 stays retained within the cap 108 in a non-engaged position with respect to the valve stem 212 to prevent the unintentional release of fluid. In the present embodiment, the valve stem 212 is disposed partially within the conical docking base 314 and in a non-engaged relationship with the docking base 220 to prevent unintentional fluid release. In other embodiments, the conical docking base 314 may be omitted or modified. Alternatively, the valve stem 212 may be disposed entirely beneath all portions of the manifold 106. Still further, it is contemplated that the valve stem 212 may be partially engaged with portions of the manifold 106, e.g., the docking base 220.

Figure 26A:
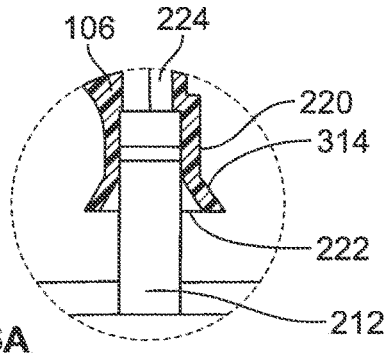
FIG. 26*a* is an enlarged partial sectional view of the dispensing system of FIG. 26 depicting the manifold fully seated on a valve stem of the container.

To place the dispensing system 300 into an active state, the manifold 106 must be released from the cap 108. To release the manifold 106 from the cap 108, a user grasps the wings 130A, 130B of the shroud 102 and exerts a force directed generally along the arrows B to press the wings together. When the wings 130A, 130B are pressed together, the first wing 130A moves inwardly and presses against the downwardly extending wall 236 of the manifold 106, which causes the manifold 106 to move generally in the direction of arrow A as seen in FIG. 26. As the manifold 106 moves back toward the second wing 130B the cylindrical members 238A, 238B leave the semicircular recesses 308A, 308B and ride down the angled ramps 306A, 306B of the cap 108. The movement of the cylindrical members 238A, 238B causes the manifold 106 to release from the protrusions 310A, 310B in the cap 108. Additionally, the conical docking base 314 guides the base member 220 of the manifold 106 over the valve stem 212 of the container 104, allowing the manifold 106 to sealingly connect with the valve stem 212 (see FIG. 26*a*).

In a preferred embodiment, the grooves 312A, 312B and the protrusions 310A, 310B are used only once. Upon release of the manifold 106 from the cap 108 and seating of the base member 220 on the valve stem 212 the dispensing system 300 is placed in an operational state. Thereafter, the dispensing device 300 is operated in the same manner as described above. A user squeezes one or more of the wings 130A, 130B of the shroud 102 to cause the first wing 130A to press against the downwardly extending wall 236 of the manifold 106. The manifold 106 moves back toward the second wing 130B and the valve stem 212 of the container 104 is moved in a generally radial and/or axial direction due to the coupling between the base member 220 of the manifold 106 and the valve stem 212. Consequently, the valve stem 212 is actuated and fluid is dispensed from the dispensing system 300.

Figure 27:
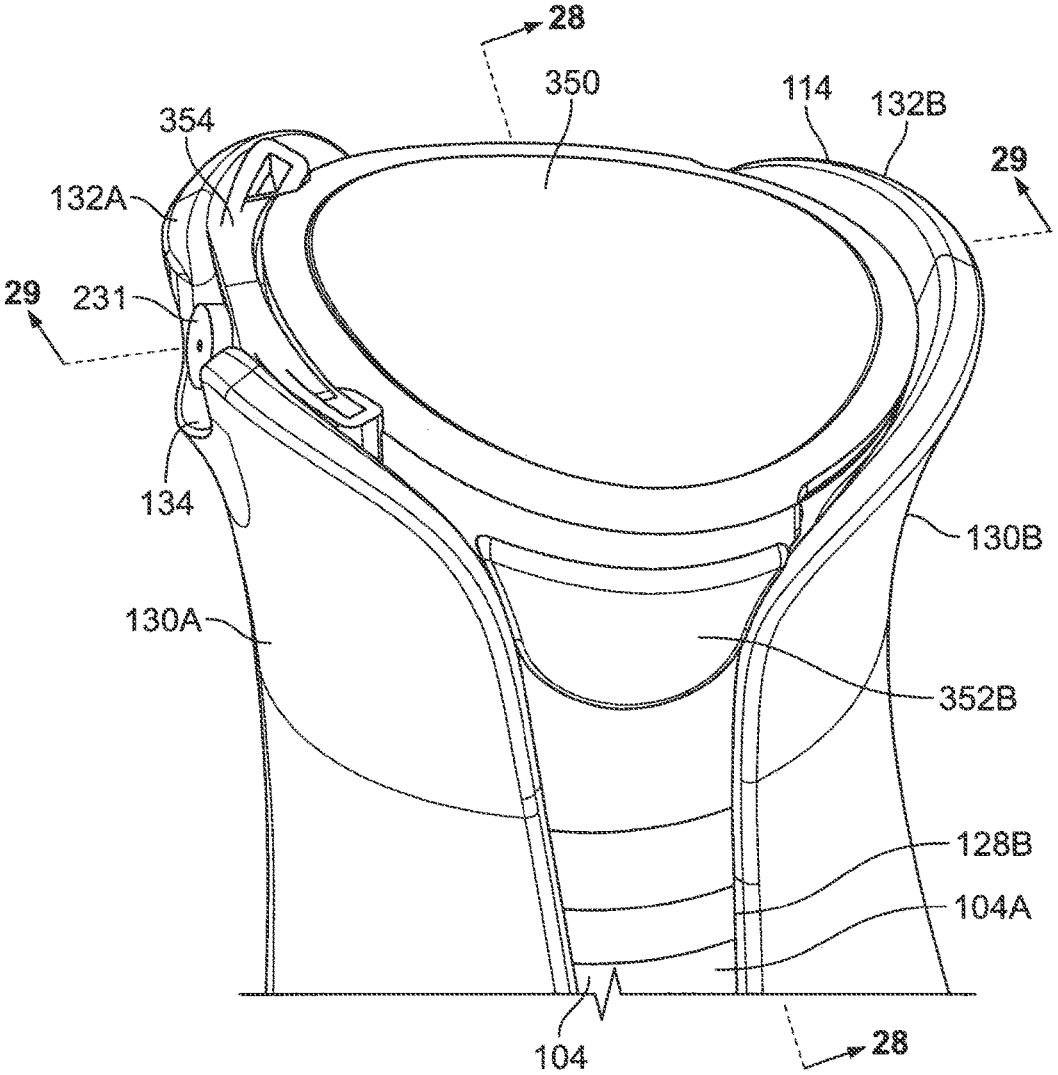
FIG. 27 is a partial isometric view of the dispensing systems of FIG. 1 or 17 including a removable locking mechanism.
Figure 28:
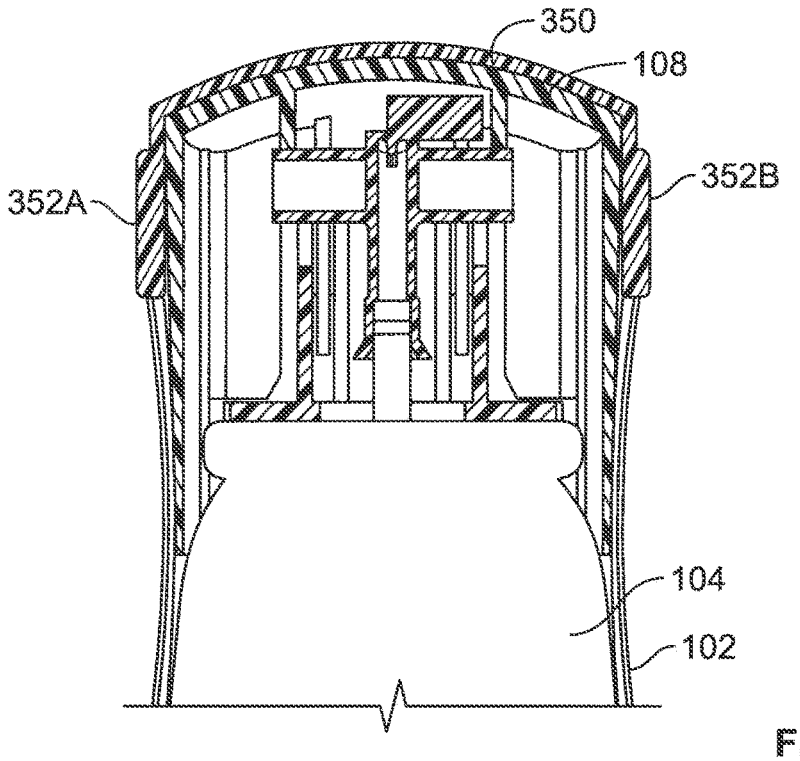
FIG. 28 is a cross-sectional view of the dispensing system and locking mechanism of FIG. 27 taken generally along the line 28-28 of FIG. 27.
Figure 29:
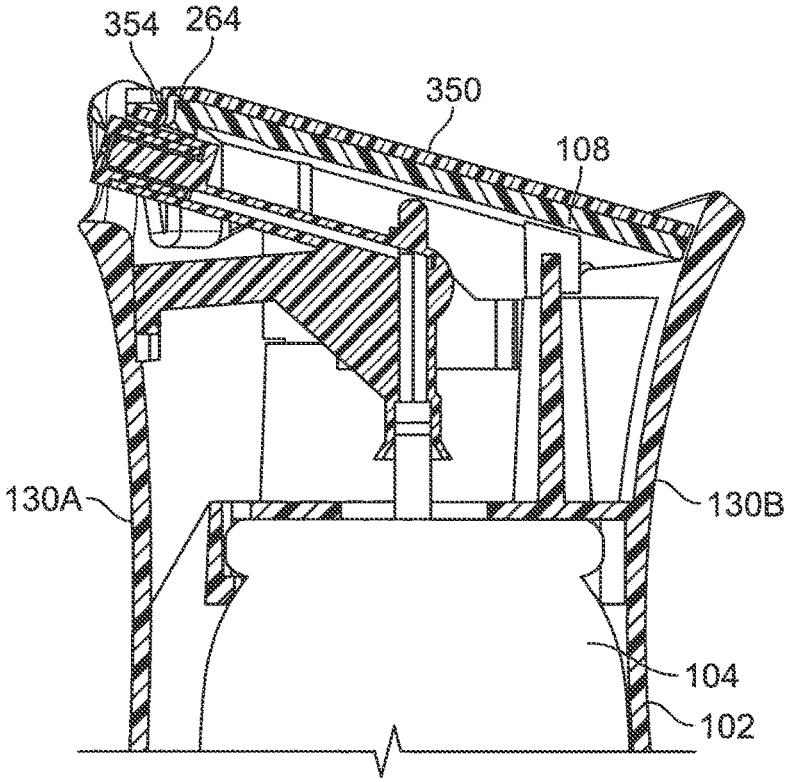
FIG. 29 is a cross-sectional view of the dispensing system and locking mechanism of FIG. 27 taken generally along the lines 29-29.

Other modifications can be made to the dispensing systems 100, 300 without departing from the spirit of the present disclosure. For example, FIG. 27 illustrates a removable locking mechanism 350 that can be placed over the cap 108 of the dispenser 100, 300. The locking mechanism 350 prevents the dispenser 100, 300 from actuating during transportation. The locking mechanism 350 includes two wing-like tabs 352A and 352B that extend over the sides of the cap 108 and sit within the U-shaped cutouts 128A, 128B (see FIGS. 27 and 28). The tabs 352A, 352B keep the first wing 130A of the shroud 102 from pressing back toward the second wing 130B. The locking mechanism 350 also includes a front piece 354 that extends between the front wall 264 of the cap 108 and the first wing 130A of the shroud 102 (see FIGS. 27 and 29). The front piece 354 also prevents the first wall 130A of the shroud from pressing back and actuating the dispensing system 100, 300. Prior to use, the user removes the locking mechanism 350 to place the dispensing system 100, 300 into an operable state.

Figure 30:
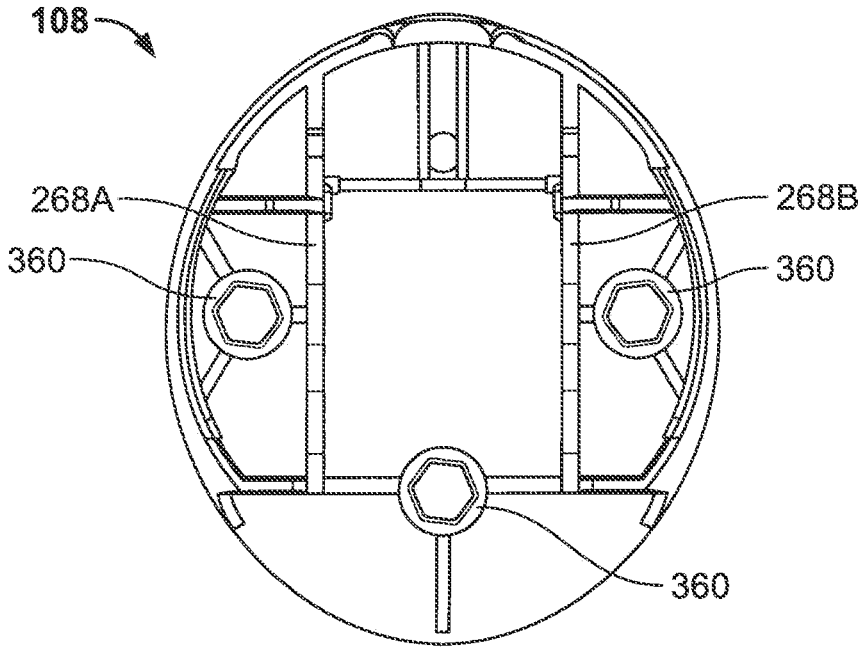
FIG. 30 is a bottom elevational view of a further embodiment of the cap of FIG. 1 or 17.
Figure 31:
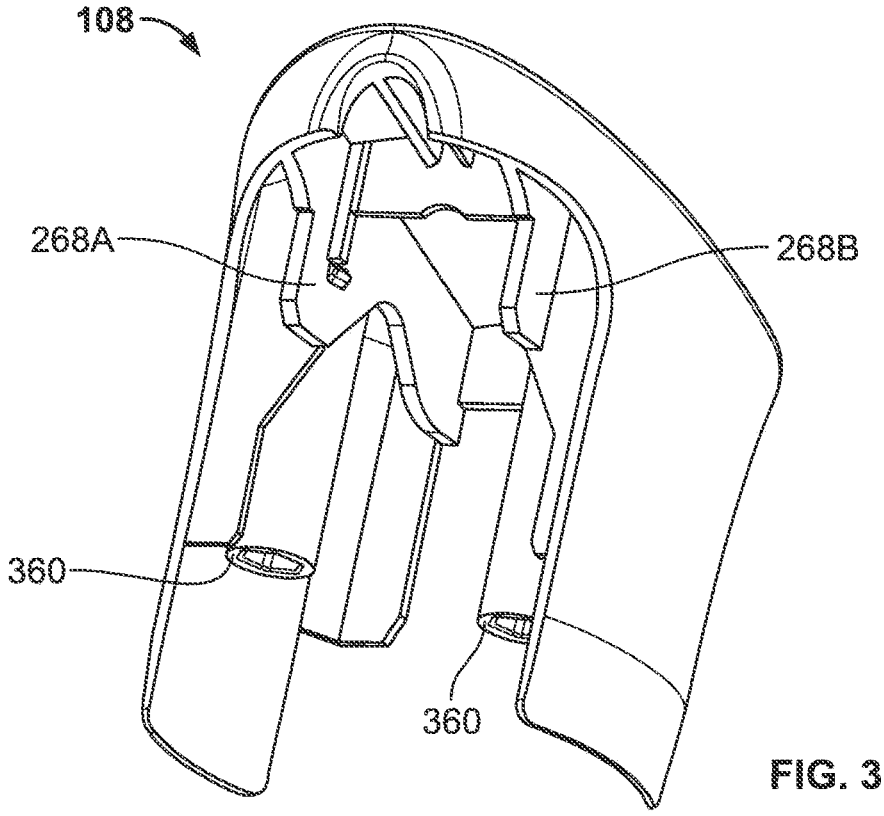
FIG. 31 is an isometric view of a bottom, front, and right side of the cap of FIG. 30.
Figure 32:
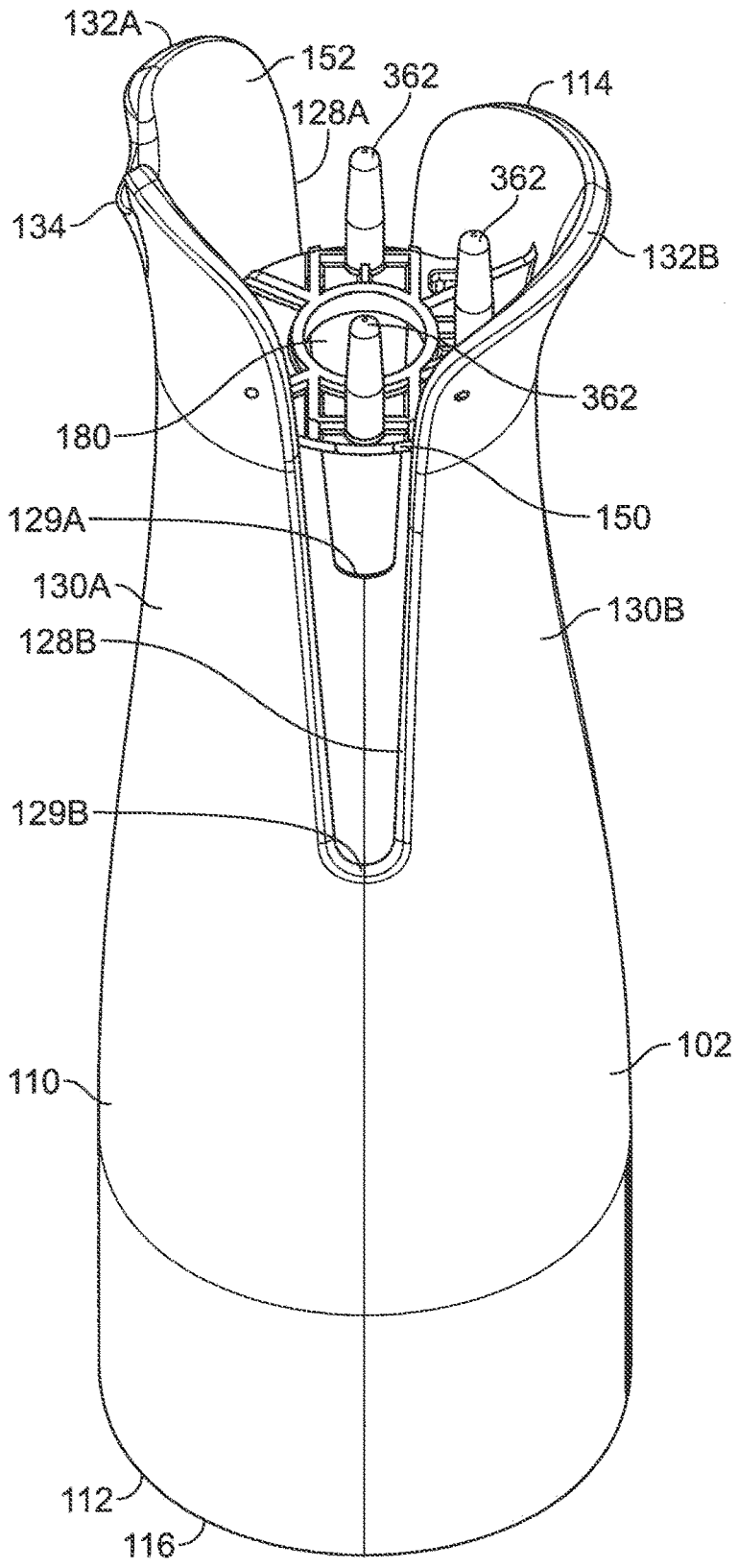
FIG. 32 is an isometric view of a further embodiment of the shroud of FIG. 1 or 17 for use in conjunction with the cap of FIGS. 30 and 31.

FIGS. 30-32 illustrate an alternative embodiment for attaching the cap 108 to the shroud 102 of the dispensing systems 100, 300. Tubular members 360 are disposed on the underside of the cap 108 (see FIGS. 30 and 31), which fittingly engage with receiving posts 362 provided on the horizontal platform 150 (see FIG. 32) to retain the cap 108 within the shroud 102. Further, other fastening means and embodiments for attaching the cap 108 to the shroud 102 can be made without departing from the spirit of the present disclosure.

Figure 34:
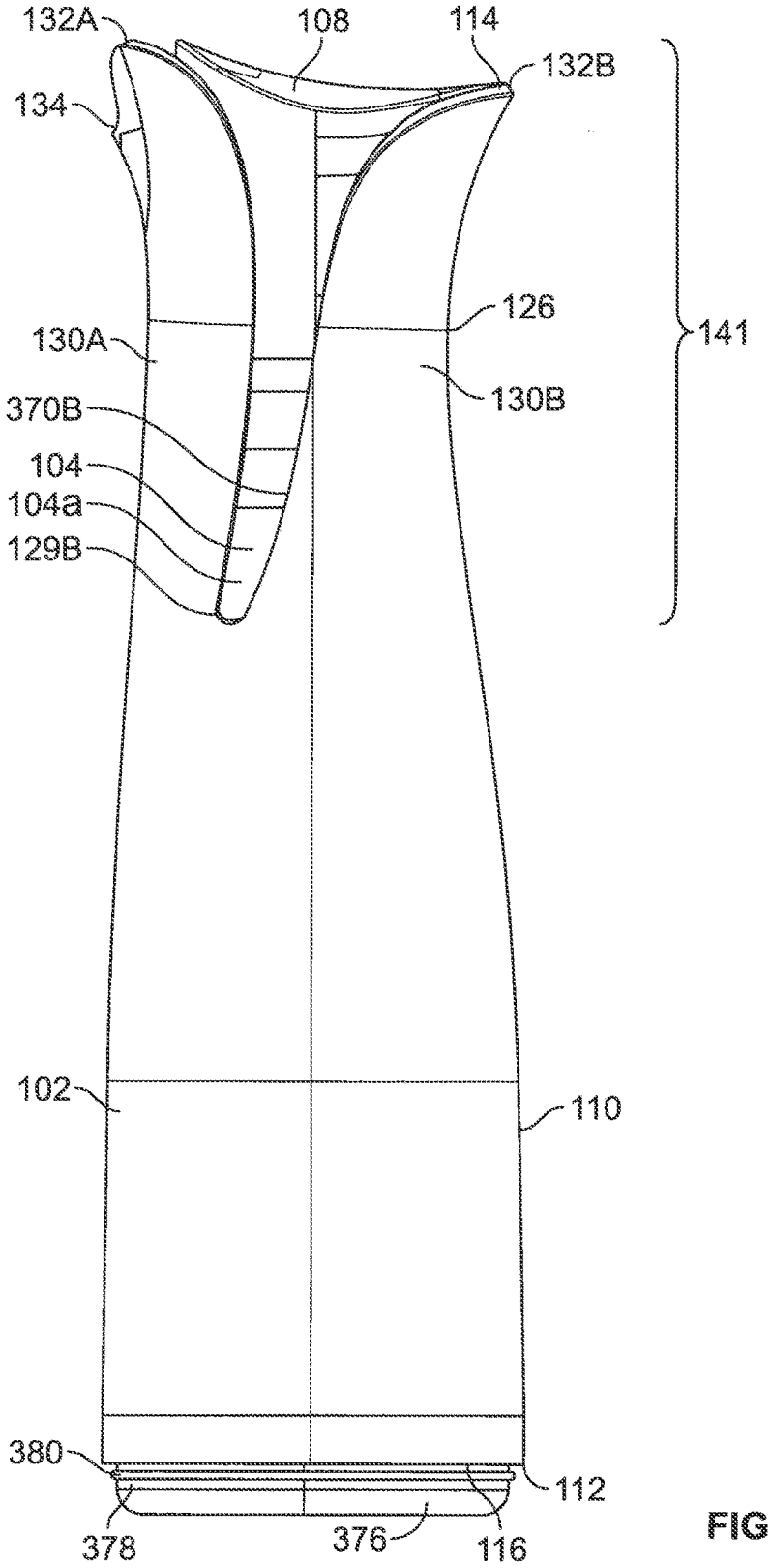
FIG. 34 is a right side elevational view of the embodiment of FIG. 33, the left side being a mirror image thereof.

As shown in FIGS. 33 and 34, the shroud 102 described with any of the previous embodiments may be modified to include tapered cutouts 370A, 370B (only 370B is shown, 370A being a mirror image thereof) instead of the U-shaped cutouts 128A, 128B, respectively. The tapered cutouts 370A, 370B extend into the first wing 130A of the shroud 102. The tapered cutouts 370A, 370B facilitate the actuation of the device by requiring less force to actuate the first wing 130A, i.e., it is easier to squeeze and inwardly depress the first wing 130A.

Figure 35:
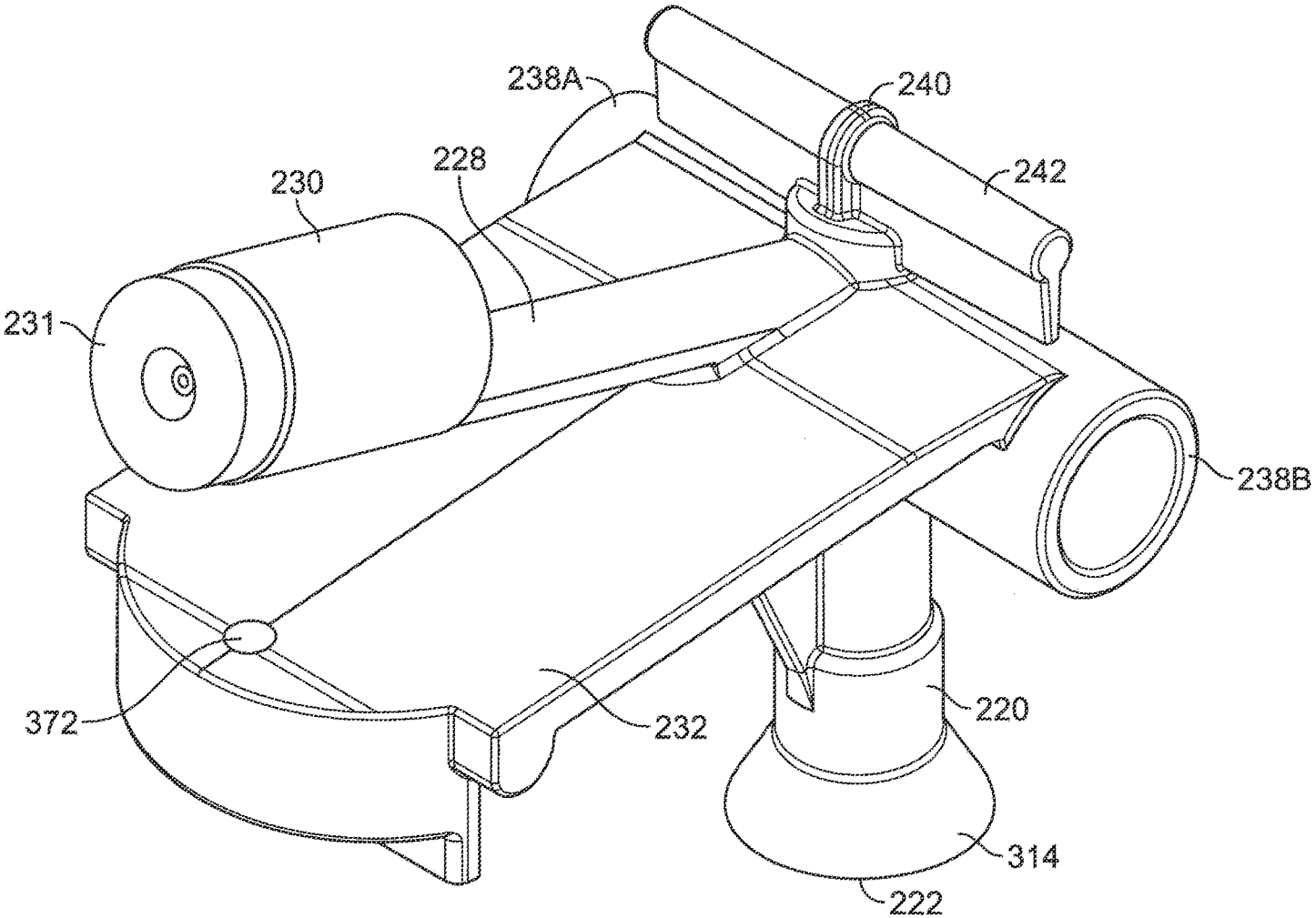
FIG. 35 is an isometric view of a further embodiment of the manifold.
Figure 36:
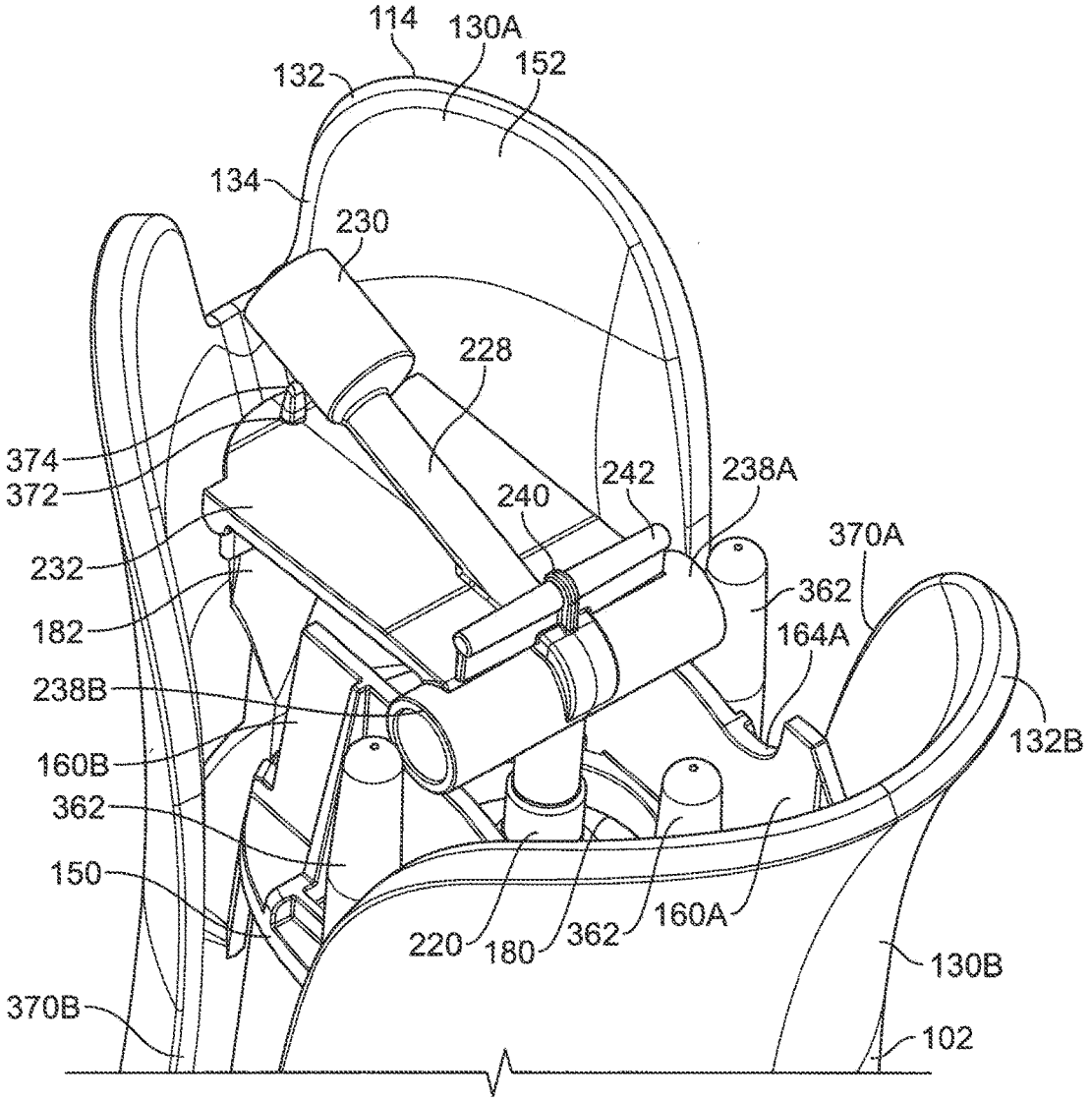
FIG. 36 is an isometric view of a further embodiment of the shroud of FIG. 1 or 17 for use in conjunction with the manifold of FIG. 33.
Figure 37:
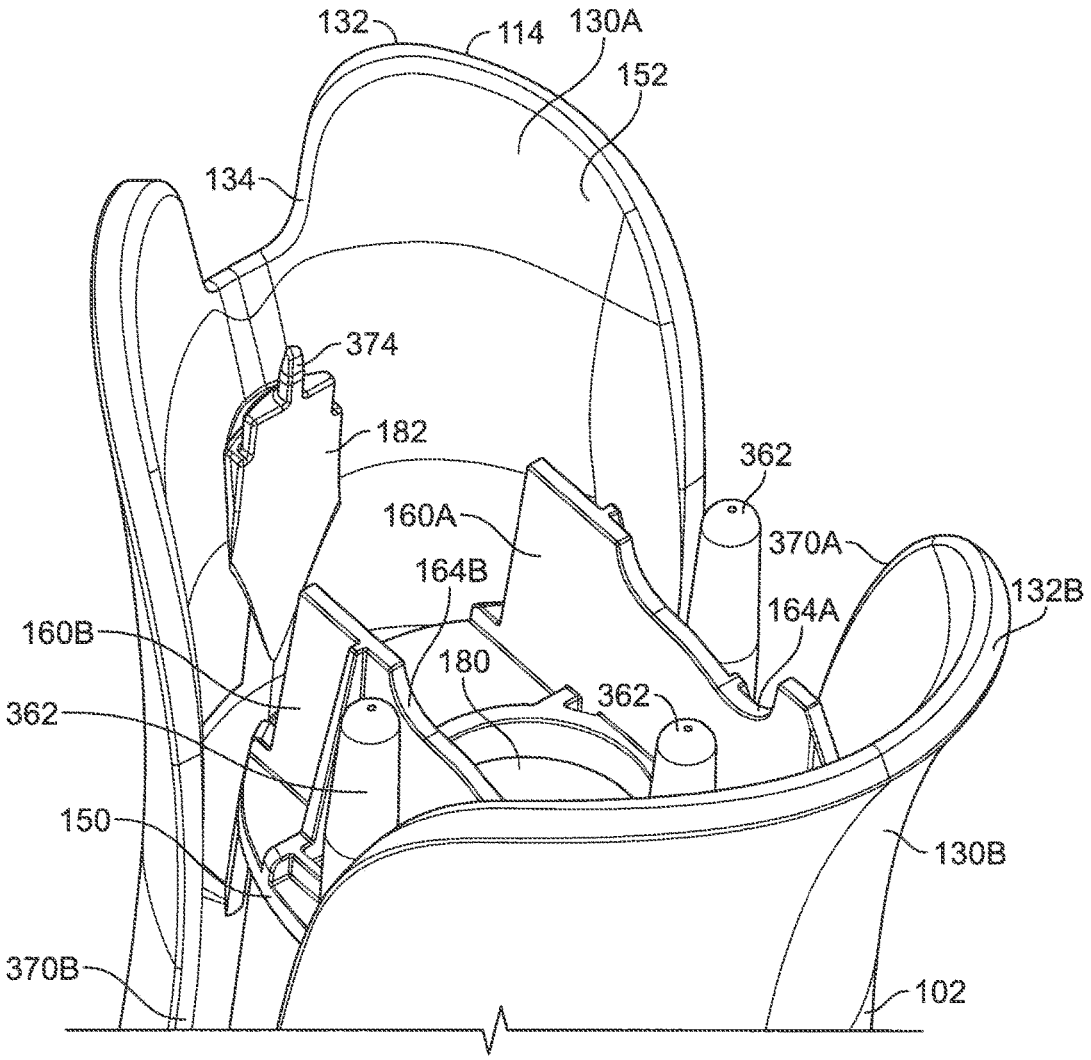
FIG. 37 is a view similar to FIG. 36, wherein the manifold has been removed.
Figure 38:
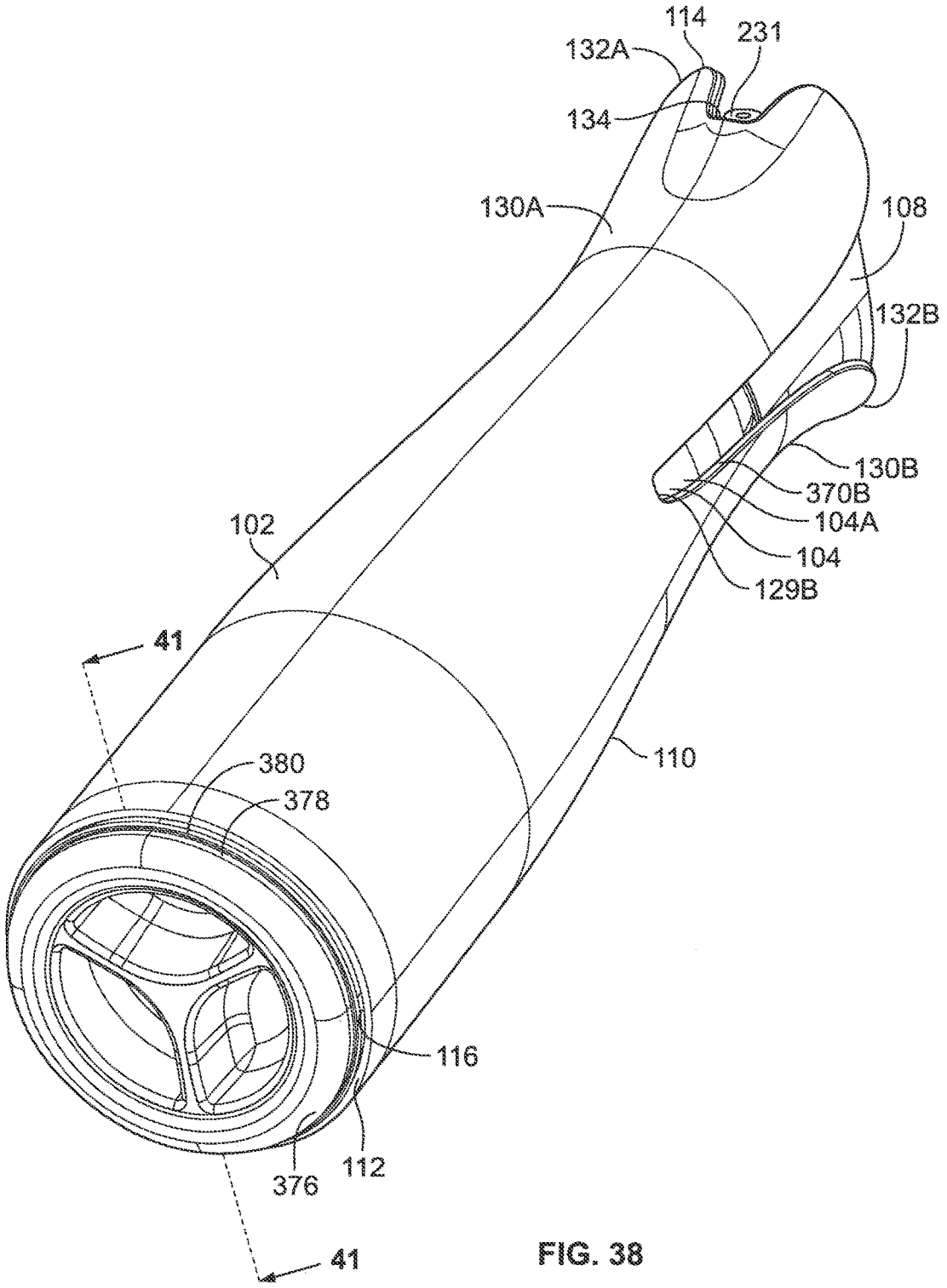
FIG. 38 is an isometric view of a further embodiment of the dispensing systems of FIG. 1 or 17.
Figure 39:
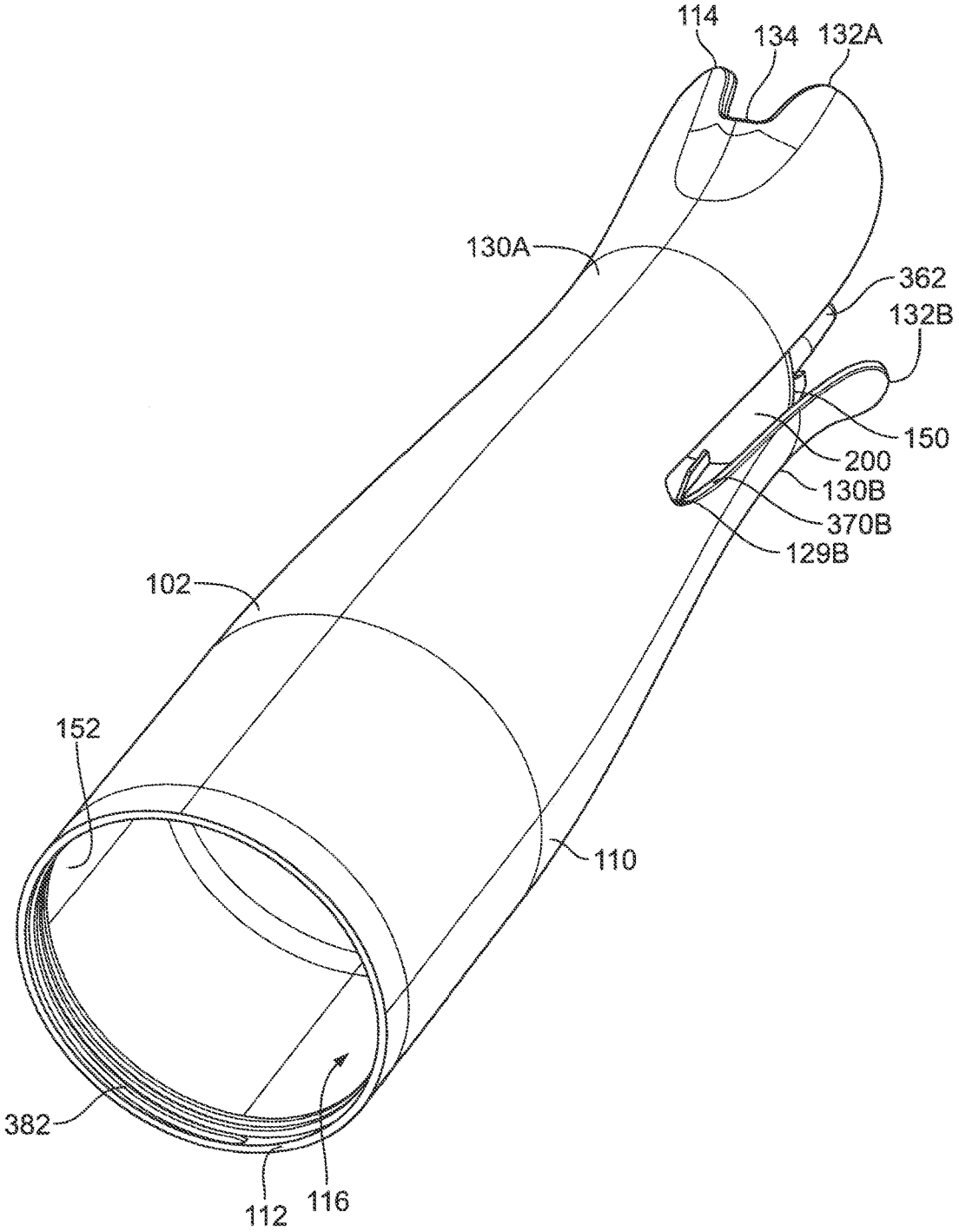
FIG. 39 is an isometric view of a shroud of FIG. 38.
Figure 40:
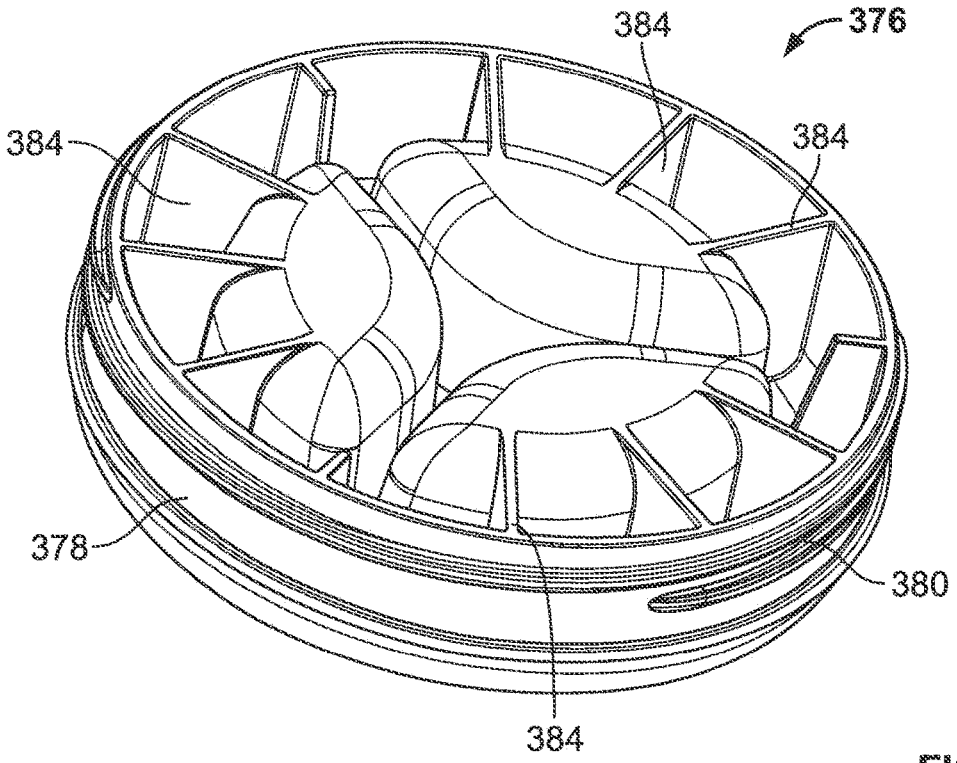
FIG. 40 is an isometric view of a door of FIG. 38.
Figure 41:
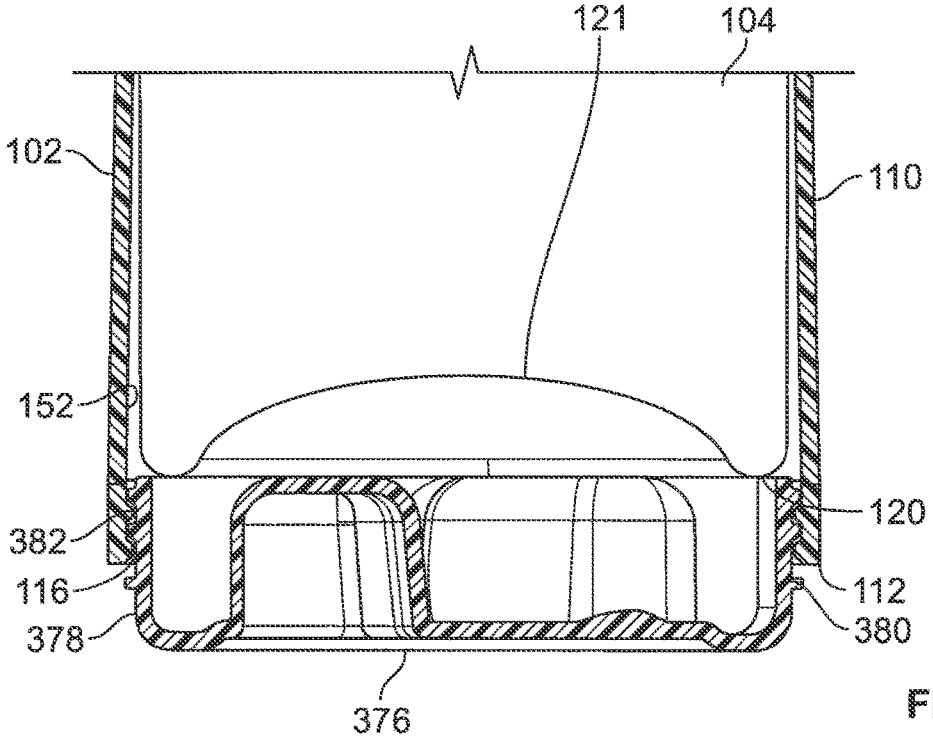
FIG. 41 is a partial cross-sectional view of FIG. 38 taken generally along the line 41-41 of FIG. 38.

FIGS. 35-37 illustrate an alternative manifold retention system for retaining the manifold 106 within the shroud 102, which may be used with any of the previous embodiments. The manifold 106 is modified to include a circular aperture 372 disposed adjacent the distal end of the horizontal shelf 232. When the manifold 106 is inserted into the shroud 102 a cylindrical pin 374 extending upwardly from the stepped projection 182 is inserted into the cylindrical aperture 372 (see FIG. 37). This aperture 372 and pin 374 combination prevents the removal or disruption of the manifold 106 when the dispensing system 100 is operated or when the container 104 is replaced.

In an alternative embodiment, shown in FIGS. 38-41, the dispensing systems 100, 300 may be modified to include a removable door 376 to assist in the removal and retention of the container 104. The door 376 is similar in shape to the opening 116 defined by the bottom edge 112 of the shroud 102. A peripheral surface 378 of the door includes a threading 380, which engages with a threaded section 382 disposed on the inner surface 152 of the shroud 102 adjacent the bottom edge 112 thereof. In an assembled condition, the container 104 is inserted through the opening 116 in the shroud 102. The door 376 is then rotatably attached to the threaded section 382 of the shroud 102, thereby retaining the container 104 within the shroud 102. When the door 376 is attached to the shroud 102 a plurality of ribs 384 disposed within an interior 386 of the door 376 contact the bottom edge 120 of the container 104. The ribs 384 cause the mounting cup 210 of the container 104 to be held against the bottom side 200 of the platform 150 without the need for the plurality of hooks 202 as described in the previous embodiments. In other embodiments, the door 376 may include additional supports designed to assist in holding the container 104 against the bottom side 200 of the platform 150. For example, the door 376 may include a central domed portion (not shown) designed to interact with a central domed portion 121 of the container 104. When the door 376 is attached to the shroud 102 the valve stem 212 of the container 104 extends through the aperture 180 and engages with the manifold 106 as described above. In use, a user may unscrew the door 376 to remove the container 104 from the shroud 102 and replace it. It is contemplated that other means for opening and closing the door 376 such as snap-fit engagements can be used to close the opening 116 of the shroud 102 without departing from the spirit of the present disclosure.

Figure 42:
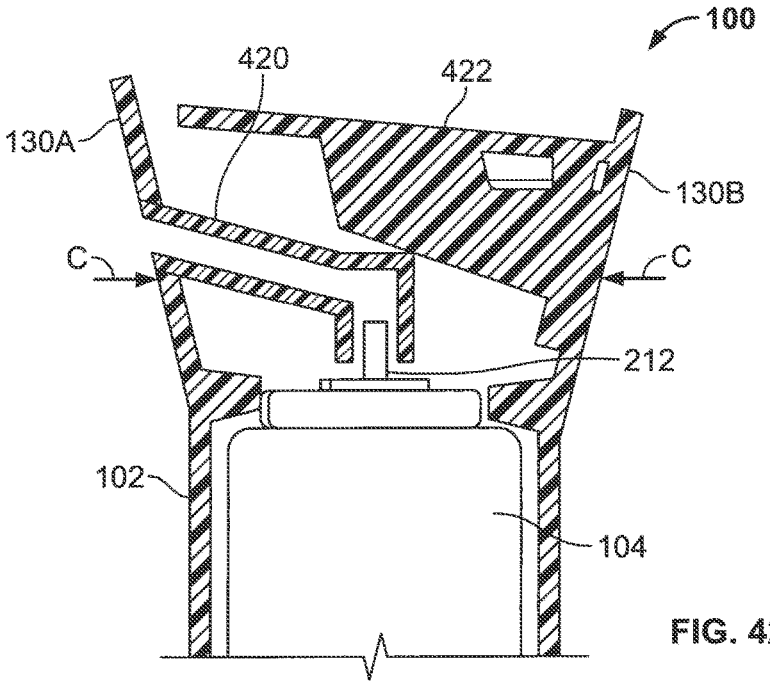
FIG. 42 is a diagrammatic cross-sectional view similar to FIG. 15 of a further embodiment of a dispensing system that includes a different actuation mechanism.

FIG. 42 illustrates another embodiment of the dispensing system 100 that includes features that enable both of the wings 130A, 130B to be moveable with respect to the container 104 to dispense liquid therefrom. In FIG. 34, a discharge member 420 extends from the first wing 130A and is coupled to the valve stem 212 of the container 104. A wedge-shaped member 422 extends from the second wing 130B. In the present embodiment, when a user grasps the wings 130A, 130B and exerts an inward force directed generally along the arrows C, movement of the first wing 130A inwardly causes the discharge member 420 to actuate the valve stem 212. In addition, movement of the second wing 130B inwardly causes the wedge-shaped member 422 to press against the discharge member 420 to actuate the valve stem 212. Indeed, it is contemplated that during an actuation sequence both of the wings 130A, 130B may exert forces, which are transferred to the valve stem 212 to actuate same. In the present embodiment, the movement of both wings 130A, 130B may further reduce the overall force necessary to actuate the system 100 per unit area of the user's hand in contact with the shroud 102 over other trigger/button actuated systems.

Figure 43:
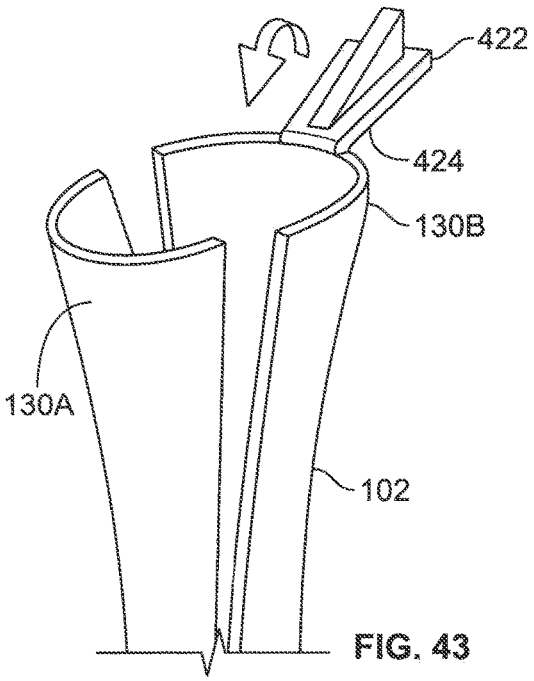
FIGS. 43 and 44 are further diagrammatic views of another embodiment of the dispensing system of FIG. 42.
Figure 44:
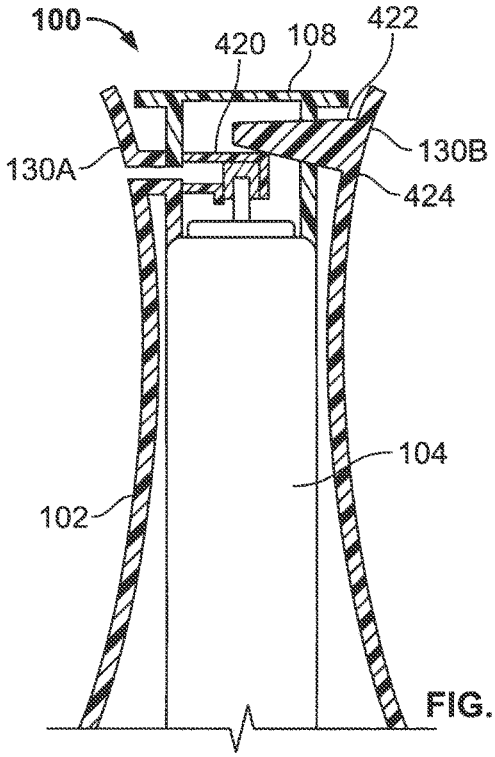

FIGS. 43 and 44 illustrate another example, similar to FIG. 42, wherein the wedge-shaped member 422 is connected to the second wing 130B by a hinge 424. In the present embodiment, the wedge-shaped member 422 becomes locked against the discharge member 420 when the cap 108 is disposed on the shroud 102.

Figure 45:
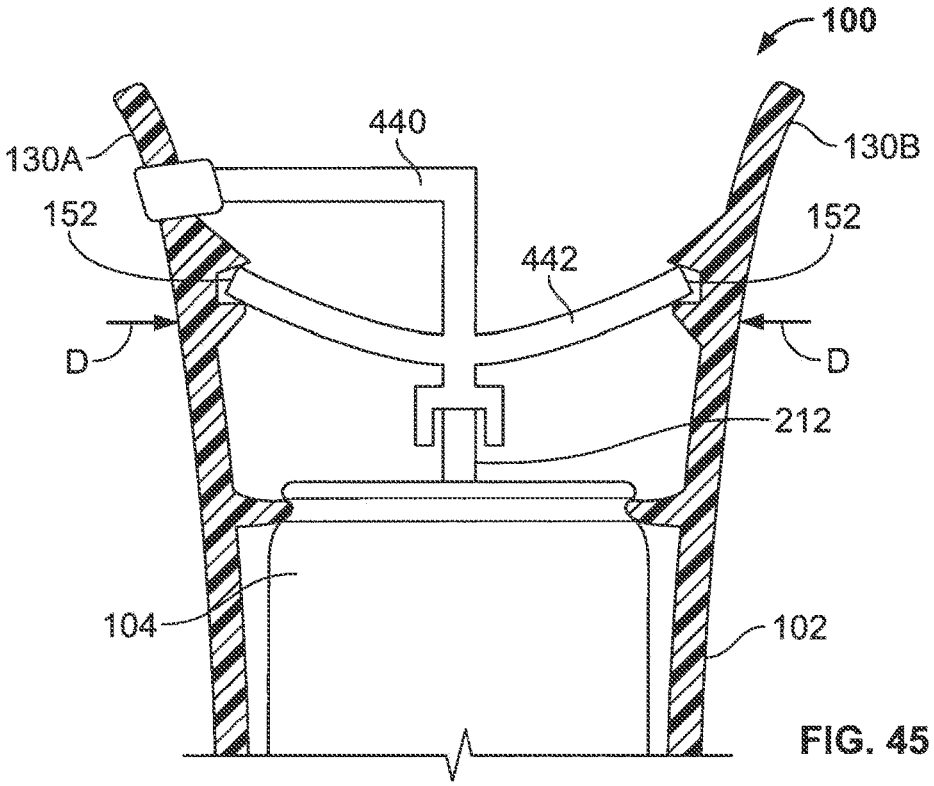
FIG. 45 is a diagrammatic cross-sectional view similar to FIG. 42 of a further embodiment of a dispensing system that includes an alternative actuation mechanism.

FIG. 45 illustrates yet another example of the dispensing system 100 that includes features that enable both of the wings 130A, 130B to be moveable with respect to the container 104 to dispense liquid therefrom. In FIG. 45, a discharge member 440 is coupled to the valve stem 212 of the container 104 and further includes a concave spring 442 that is retained between inner surfaces 152 of the wings 130A, 130B. When a user grasps the wings 130A, 130B and exerts an inward force directed generally along the arrows D, the concave spring 442 flexes downwardly to actuate the valve stem 212. Like the embodiment of FIGS. 42-44, the movement of both wings 130A, 130B may further reduce the overall force necessary to actuate the system 100 per unit area of the user's hand in contact with the shroud 102 over other trigger/button actuated systems.

Figure 46:
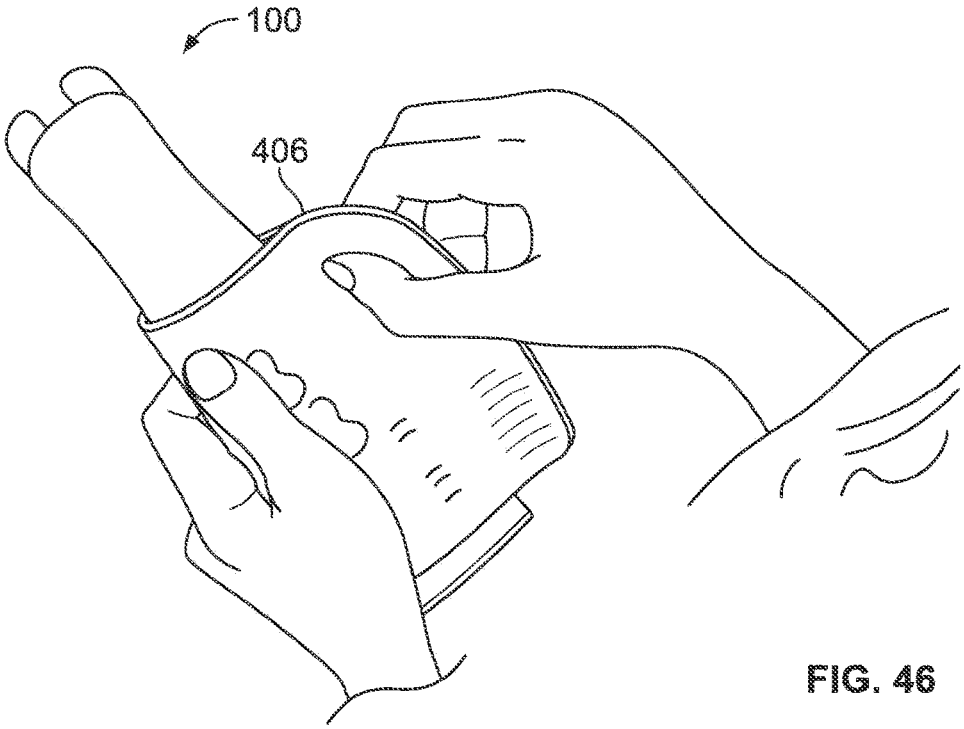
FIG. 46 is a diagrammatic view of a further embodiment of a dispensing system that includes peel away labeling.

FIG. 46 generally illustrates a different feature that may be included with the dispensing systems described herein. In FIG. 46, peel away labeling 406 has been added to the shroud, the cap, and/or the container to provide use and/or purchasing information, which can later be removed by a user. Other permanent and/or removable labeling can be applied to any portion of the dispensing system, e.g., the cap 108 may include brand information so that the dispensing system can be easily distinguished from other dispensers.

Figure 47:
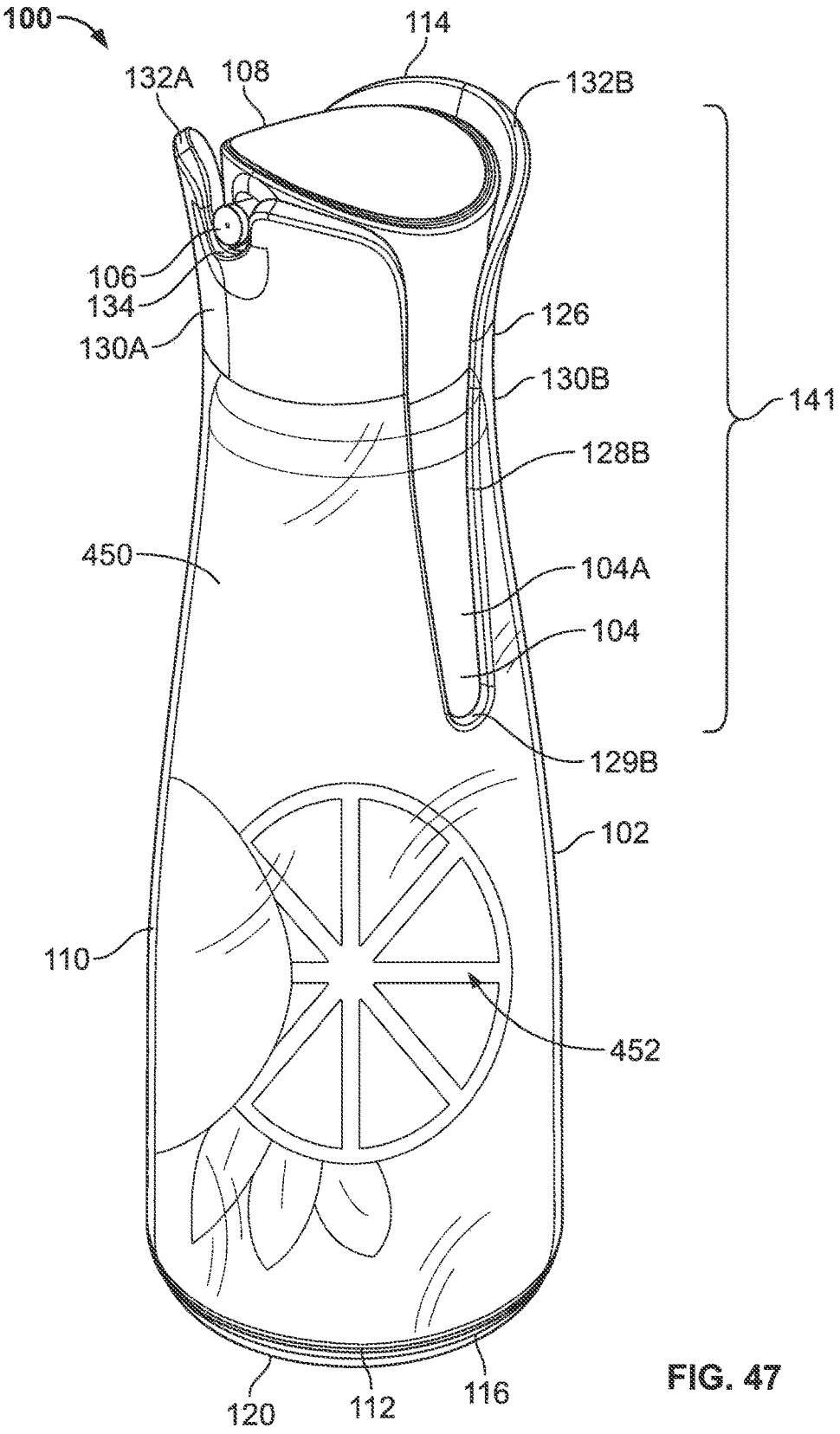
FIG. 47 illustrates an isometric view of a top, front, and right side of the dispensing system of FIG. 1 according to another example, wherein the shroud includes a transparent portion.

Further, the shroud 102, the container 104, the manifold 106, and the cap 108 can be made from any suitable materials, as would be apparent to one of ordinary skill in the art. In one embodiment, referring to FIG. 47, a portion 450 or the entire shroud 102 is transparent or translucent so that a user can view surface indicia or graphics 452 on the container 104 therethrough. In various non-limiting examples, the portion 450 is made from a clear plastic, e.g., clarified polypropylene, polycarbonate, PET, Eastman Tritan™, and Barex™. The portion 450 may comprise the entire shroud 102 or only portions of the shroud, e.g., portions below the inflexion point 126 or portions adjacent areas of the container that include distinguishing indicia or graphics. As discussed above, the shrouds disclosed herein can be reused with different containers, which may include different surface indicia, colors, or graphics to distinguish one container from another. In the present embodiment, the transparent or translucent portion 450 allows a user to conveniently and easily see which container is disposed within the shroud before picking up the dispensing system 100 to dispense liquid from the container. In embodiments where the shroud 102 is not transparent or translucent the user can still see which container is disposed within the shroud by viewing the container's surface indicia, color, or graphics, which are visible through the U-shaped cutouts.

Figure 48:
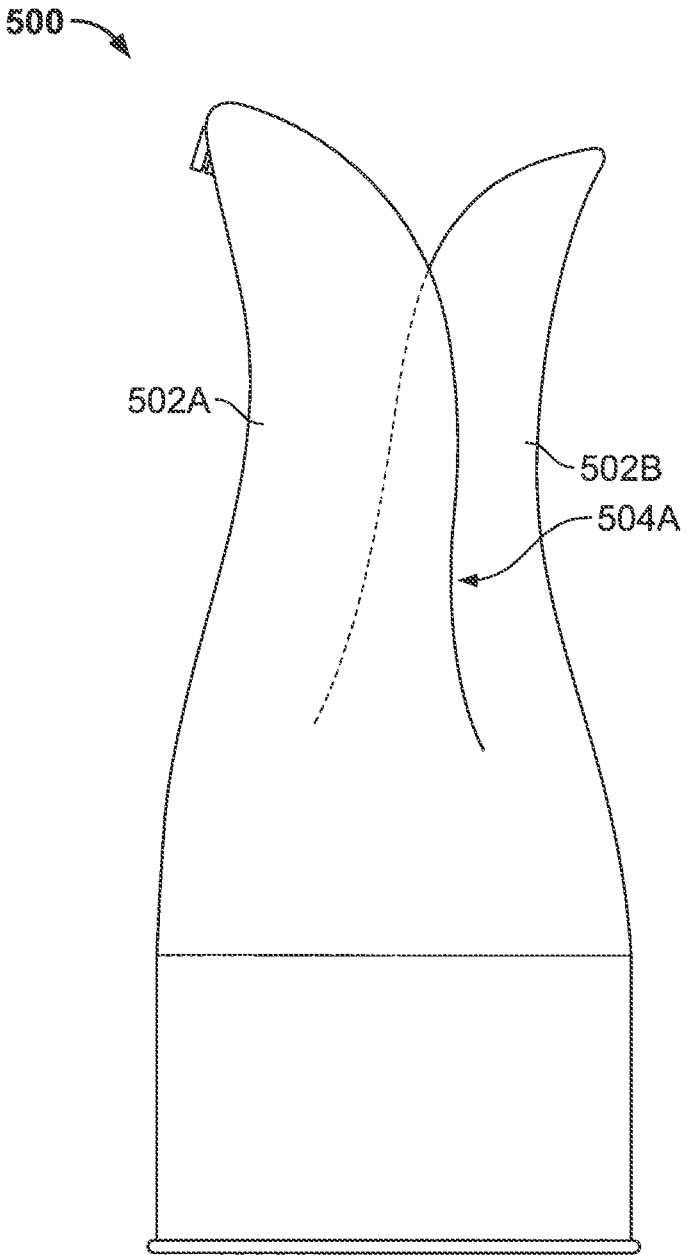
FIG. 48 is a schematic side elevational view of a different embodiment of a dispensing system having overlapping first and second actuation areas separated by cutouts.

FIG. 48 depicts a different embodiment of a dispensing system 500 having overlapping members 502A, 502B separated by cutouts 504A, 504B (only cutout 504A is shown). As previously noted, cutouts of any of the described embodiments may be fashioned in any manner insofar as it facilitates the movement of one or more actuation areas to effect operation of the dispensing system. In the present embodiment, a user squeezing one or more of the members 502A, 502B will cause the member 502A, i.e. the actuation member or area of the present embodiment, to slide over portions of the second member 502A to effect actuation of the dispensing system 500 by any of the above-noted actuation mechanisms.

In yet further examples, the dispensing system 100 disclosed herein may be used with other types of dispensing mechanisms, e.g., pump action dispensers, electromechanical atomizers, wick-based systems, etc., as would be apparent to one of ordinary skill in the art. Further, the shroud 102 and/or container 104 may be shaped differently to accommodate other design choices. Still further, the container 104 may hold any type of fluid product or other substance that is to be dispensed. The product may be in any suitable form including liquid or gas. The container may include a propellant or other compressed gases to facilitate the release thereof. The fluid may be a fragrance or insecticide disposed within a carrier liquid, a deodorizing liquid, a cleaning and/or polishing formulation or the like. For example, the fluid may comprise PLEDGE®, a surface cleaning composition for household, commercial, and institutional use, or GLADE®, a household deodorant, both sold by S. C. Johnson and Son, Inc., of Racine, Wis. The fluid may also comprise other actives, such as sanitizers, air fresheners, odor eliminators, mold or mildew inhibitors, insect repellents, and the like, or that have aromatherapeutic properties. The fluid alternatively comprises any fluid known to those skilled in the art that can be dispensed from the container 104.

Other embodiments of the disclosure including all the possible different and various combinations of the individual features of each of the foregoing described embodiments and examples are specifically included herein.

INDUSTRIAL APPLICABILITY

The dispensing system described herein advantageously allows for the dispensing of a fluid product therefrom by application of a force to a shroud holding a container. Various features provide an ergonomic gripping surface and give visual and spatial indicators to the user to facilitate product dispensing.

Numerous modifications will be apparent to those skilled in the art in view of the foregoing description. Accordingly, this description is to be construed as illustrative only and is presented for the purpose of enabling those skilled in the art to make and use what is herein disclosed and to teach the best mode of carrying out same. All patents, patent applications, and other references cited herein are incorporated herein by reference as if they appear in this document in their entirety. The exclusive rights to all modifications which come within the scope of this disclosure are reserved.

We claim:

1. A dispensing system, comprising:

a manifold adapted to be fluidly coupled to a valve stem of a container, wherein the manifold includes first and second members extending outwardly from the manifold;

a shroud having first and second shroud portions on opposing sides of the shroud, and at least one rail defining a portion of at least one enclosed track, the at least one enclosed track receiving and permitting sliding of at least one of the first and second members.

2. The dispensing system of claim 1, further comprising a platform extending beyond one of the shroud portions toward the other, wherein the at least one track comprises first and second tracks, wherein the platform includes first and second rails extending therefrom, the first and second rails including the at least one rail, and wherein the first and second rails form portions of the first and second tracks, respectively.

3. The dispensing system of claim 1, further comprising a cap including first and second rails extending from a bottom surface thereof, the first and second rails including the at least one rail, wherein the at least one track comprises first and second tracks, and wherein the first and second rails form portions of the first and second tracks, respectively.

4. The dispensing system of claim 3, further comprising a platform extending beyond one of the shroud portions toward the other, wherein the platform includes first and second rails extending therefrom, and wherein the first and second rails of the platform interface with the first and second rails of the cap in order to form the first and second tracks, respectively.

5. The dispensing system of claim 4, wherein the first rails of the platform and the cap are parallel with the second rails of the platform and the cap, respectively.

6. The dispensing system of claim 4, wherein the first and second rails of the cap are vertically aligned with the first and second rails of the platform, respectively.

7. The dispensing system of claim 3, wherein the cap is inserted over the manifold within the shroud.

8. The dispensing system of claim 1, wherein the shroud is removable from the container.

9. A dispensing system, comprising:

a manifold adapted to be fluidly coupled to a valve stem of a container, wherein the manifold includes first and second members extending outwardly from the manifold;

a shroud having first and second shroud portions on opposing sides of the shroud, wherein a platform extends beyond one of the shroud portions toward the other, and wherein the platform includes first and second rails extending therefrom; and a cap including first and second rails extending from a bottom surface thereof, wherein the first and second rails of the cap are aligned with the first and second rails of the platform to form first and second tracks, respectively, and wherein the first and second members are disposed within the first and second tracks, respectively.

10. The dispensing system of claim 9, wherein the first and second members are substantially cylindrical.

11. The dispensing system of claim 9, wherein the first rails of the platform and cap are parallel with the second rails of the platform and cap, respectively.

12. The dispensing system of claim 9, wherein the first and second members are constrained to movement in a direction defined by the first and second tracks, respectively.

13. The dispensing system of claim 9, wherein the first and second rails of the cap are vertically aligned with the first and second rails of the platform, respectively.

14. The dispensing system of claim 9, wherein a force applied to at least one of the first and second shroud portions in a direction substantially transverse to a longitudinal axis of the dispensing system causes the first and second members to move within the first and second tracks, respectively.

15. A dispensing system, comprising:

a manifold adapted to be fluidly coupled to a valve stem of a container, wherein the manifold includes first and second members extending outwardly from the manifold;

a shroud having first and second shroud portions on opposing sides of the shroud, the shroud further including portions of first and second tracks, wherein movement of at least one of the first and second shroud portions causes the first shroud portion to contact the manifold forcing same downwardly; and wherein the movement of the manifold is restrained by the movement of the first and second members within the first and second tracks, respectively.

16. The dispensing system of claim 15, further comprising:

a platform extending beyond one of the shroud portions toward the other, wherein the platform includes first and second rails extending therefrom; and a cap including first and second rails extending from a bottom surface thereof;

wherein the first and second tracks are formed by mating the first rail of the platform with the first rail of the cap and by mating the second rail of the platform with the second rail of the cap, respectively.

17. The dispensing system of claim 16, wherein the cap is inserted over the manifold within the shroud.

18. The dispensing system of claim 16, wherein the first and second rails of the cap are vertically aligned with the first and second rails of the platform, respectively.

19. The dispensing system of claim 15, wherein movement of the first and second members is in a direction angled with respect to a longitudinal axis of the dispensing system.

20. The dispensing system of claim 15, wherein movement of the first and second members is in a direction angled with respect to a direction substantially transverse to a longitudinal axis of the dispensing system.

* * * * *